US009241571B2

(12) United States Patent
Robertson

(10) Patent No.: US 9,241,571 B2
(45) Date of Patent: Jan. 26, 2016

(54) ADJUSTABLE FURNITURE

(75) Inventor: Dale Robertson, Gloucestershire (GB)

(73) Assignee: INTEGRATED FURNITURE TECHNOLOGIES LIMITED, Gloucestershire (GB)

( * ) Notice: Subject to any disclaimer, the term of this patent is extended or adjusted under 35 U.S.C. 154(b) by 638 days.

(21) Appl. No.: 13/390,985

(22) PCT Filed: Aug. 18, 2010

(86) PCT No.: PCT/GB2010/001565
§ 371 (c)(1),
(2), (4) Date: Apr. 18, 2012

(87) PCT Pub. No.: WO2011/021002
PCT Pub. Date: Feb. 24, 2011

(65) Prior Publication Data

US 2012/0193946 A1 Aug. 2, 2012

(30) Foreign Application Priority Data

Aug. 18, 2009 (GB) ..... 0914436.1
Oct. 23, 2009 (GB) ..... 0918685.9

(51) Int. Cl.
*A47C 1/032* (2006.01)
*A47C 1/035* (2006.01)
(Continued)

(52) U.S. Cl.
CPC ..... *A47C 1/03294* (2013.01); *A47C 1/035* (2013.01); *A47C 7/50* (2013.01); *A47C 20/08* (2013.01)

(58) Field of Classification Search
USPC ..... 297/317, 318, 322, 323, 342, 343, 297/DIG. 7, 84
See application file for complete search history.

(56) References Cited

U.S. PATENT DOCUMENTS 638,466 A * 12/1899 Kelly ..... 5/47
912,214 A 2/1909 Ward
1,238,078 A * 8/1917 Ault ..... 297/84
(Continued)

FOREIGN PATENT DOCUMENTS

DE 297 15 343 11/1997
DE 029715343 1/1998
(Continued)

OTHER PUBLICATIONS

PCT/GB2010/001565 International Search Report mailed Apr. 12, 2011, 6 pages—English.
(Continued)

*Primary Examiner* — David R Dunn
*Assistant Examiner* — Timothy J Brindley
(74) *Attorney, Agent, or Firm* — Andrew F. Young, Esq.; Lackenbach Siegel, LLP

(57) ABSTRACT

An adjustable furniture such as a recliner chair or adjustable bed comprising a base, an intermediate support and a back support. Both the intermediate support and the back support are guided for movement relative to the base by a second guide means while the base moves along a first guide means. The first guide means include at least one guide associated with one of the base and intermediate support and at least one follower associated with the other of the base and intermediate support. The second guide means includes at least one guide associated with one of the base support and the back support and at least one follower associated with the other of the base support and the back support.

46 Claims, 35 Drawing Sheets

(51) Int. Cl.

| | |
|---|---|
| ***A47C 7/50*** | (2006.01) |
| ***A47C 20/08*** | (2006.01) |

(56) References Cited

U.S. PATENT DOCUMENTS

| | | | | | |
|---|---|---|---|---|---|
| 1,414,637 | A | | 5/1922 | Gell | |
| 2,954,072 | A | * | 9/1960 | Fossati | 297/84 |
| 3,086,814 | A | * | 4/1963 | Fletcher | 297/84 |
| 3,121,589 | A | * | 2/1964 | Schliephacke | 297/84 |
| 3,202,453 | A | * | 8/1965 | Richards | 296/66 |
| 3,269,767 | A | * | 8/1966 | Marzocchi | 297/29 |
| 3,873,152 | A | | 3/1975 | Garas | |
| 4,547,017 | A | | 10/1985 | Lescure | |
| 4,635,999 | A | * | 1/1987 | Simpson | 297/88 |
| 5,112,109 | A | * | 5/1992 | Takada et al. | 297/343 |
| 5,246,266 | A | * | 9/1993 | Ostergaard | 297/84 |
| 5,785,384 | A | | 7/1998 | Sagstuen | |
| 5,897,462 | A | * | 4/1999 | St. Germain | 482/66 |
| 6,059,364 | A | * | 5/2000 | Dryburgh et al. | 297/354.13 |
| 6,568,755 | B1 | * | 5/2003 | Groening | 297/256.13 |
| 6,641,214 | B2 | * | 11/2003 | Veneruso | 297/322 |
| 6,739,661 | B1 | * | 5/2004 | Dukes | 297/256.13 |
| 7,219,958 | B2 | * | 5/2007 | Yamazaki et al. | 297/256.13 |
| 7,390,060 | B2 | * | 6/2008 | Kristen | 297/343 |
| 7,445,279 | B2 | * | 11/2008 | Crum | 297/84 |
| 7,703,851 | B2 | * | 4/2010 | Nakaya et al. | 297/344.15 |
| 7,997,654 | B2 | * | 8/2011 | Ferry et al. | 297/342 |
| 8,303,036 | B2 | * | 11/2012 | Hankinson et al. | 297/342 |
| 8,403,415 | B2 | * | 3/2013 | Lawson | 297/329 |
| 8,424,964 | B2 | * | 4/2013 | Campbell et al. | 297/216.11 |
| 8,534,758 | B2 | * | 9/2013 | Rivera | 297/342 |
| 2002/0060483 | A1 | * | 5/2002 | Yoshida et al. | 297/250.1 |
| 2003/0172455 | A1 | | 9/2003 | Roma et al. | |
| 2004/0155504 | A1 | | 8/2004 | Tada | |
| 2007/0120409 | A1 | * | 5/2007 | Leeds | 297/423.26 |
| 2007/0158980 | A1 | * | 7/2007 | LaPointe et al. | 297/84 |
| 2008/0150329 | A1 | * | 6/2008 | Lawson | 297/84 |

FOREIGN PATENT DOCUMENTS

| | | |
|---|---|---|
| DE | 010152227 | 5/2003 |
| DE | 10 2007 024 218 | 11/2008 |
| DE | 10 2007 024218 | 11/2008 |
| DE | 102007024218 | 11/2008 |
| EP | 0781518 | 12/1996 |
| EP | 0865960 | 3/1998 |
| EP | 0865960 | 9/1998 |
| EP | 0 891 730 | 1/1999 |
| EP | 1 621 173 | 2/2006 |
| GB | 0101239 | 8/1916 |
| GB | 0329834 | 5/1930 |
| GB | 0414464 | 8/1934 |
| GB | 0775679 | 5/1957 |
| GB | 2227932 | 8/1990 |
| GB | 2486335 | 6/2012 |
| GB | 2472920 | 2/2014 |
| GB | 2501993 | 4/2014 |
| GB | 191322022 | 8/2014 |
| JP | 36-13946 | 5/1936 |
| JP | 61 181562 | 11/1986 |
| JP | 08-173263 | 7/1996 |
| JP | 08-308680 | 11/1996 |
| JP | 11-244096 | 9/1999 |
| JP | 2003-144262 | 5/2003 |
| WO | WO 2006/023447 | 3/2006 |
| WO | WO/2011/021002 | 2/2011 |
| WO | WO 2011/048384 | 4/2011 |

OTHER PUBLICATIONS

International Search Report for PCT/GB2010/001565 dated May 26, 2011, 6 pages.

Combined Search and Examination report for GB 1013879.0, dated Dec. 7, 2010 (6 pages).

International Search Report for PCT/GB2010/001961 dated Nov. 2, 2011, 2 pages.

* cited by examiner

ADJUSTABLE FURNITURE

CROSS REFERENCE TO RELATED APPLICATIONS

This application relates to and claims priority from PCT/GB2010/001565 filed on Aug. 18, 2010, the entire contents of which are incorporated herein by reference, which in turn claims the priorities of the GB Application GB 0914436.1 filed on Aug. 18, 2009 and the GB Application GB 0918685.9 filed on Oct. 23, 2009.

FIGURE SELECTED FOR PUBLICATION

FIG. 5

BACKGROUND OF THE INVENTION

1. Field of the Invention

This invention relates to adjustable furniture, for example chairs, beds or the like in which the position of one part of the furniture can be moved relative to another. The adjustment may be powered using electrical motors or the like or manual.

2. Description of the Related Art

Adjustable chairs are known in which the angle of the backrest can be changed in order to provide a recline position and/or in which a moveable footrest can be moved forwards and outward. Recliner chairs of this type are available in which the adjustment is achieved manually or by one or more electric motors. Some motorised chairs have the ability to incline the seat of the chair to assist the user out of the chair from a seated position to a standing position. Adjustable beds are also known in which a head and upper back supporting part of the bed can be moved to adjust the inclination of that part relative to other parts of the bed. So called 'zero-wall' recliner chairs have been developed which enable the recliner chair to be positioned with the backrest near the wall of a room or other item of furniture but also allow the backrest to be reclined without interfering with the wall. This can be achieved by the backrest movement being coordinated with movement of the seat and the surrounding structure of the chair which the backrest is pivotally connected to.

Typically the moveable parts of such items of furniture are supported upon relatively complex support arrangements, usually including a series of metal linkages, pins and bushes, with the linkages being moveable to allow the moveable part or parts of the furniture to travel through their respective range of movement. Such support arrangements are often mechanically complex, heavy and costly making transportation, handling and use awkward. These considerations place severe restrictions on furniture design. For example, an operating mechanism for a typical recliner chair with footrest may weigh in the region of 16 Kg or so. The complex series of linkages and connections in known support arrangements often results in manufacturing variations, due to tolerances etc, which affects the stiffness or resistance to movement of the moving parts. This is a particular disadvantage in the case of manually operated furniture where identical items of furniture may require different degrees of effort to be applied by the user to adjust the furniture.

There is a requirement, therefore, for an improved support arrangement for adjustable items of furniture, in particular a support arrangement which is mechanically less complex, less heavy and less costly than hitherto known arrangements.

ASPECTS AND SUMMARY OF THE INVENTION

According to an aspect of the present invention there is provided an article of adjustable furniture comprising a base, an intermediate support and a back support, the intermediate support being guided for movement relative to the base by first guide means, the back support being guided for movement relative to both the base and intermediate support by second guide means, said second guide means including at least one guide associated with one of the base support and the back support and at least one follower associated with the other of the base support and the back support; whereby the back support is mounted for pivotal movement with respect to the said intermediate support and the first and second guide means are arranged such that, in use, pivoting of the back support relative to the intermediate support causes the intermediate support to move with respect to the base.

The above aspect of the present invention therefore provides an article of adjustable furniture in which the intermediate support and back support are moveable with respect to each other and the base support in a coordinated manner by means of the respective first and second guide means.

In a preferred embodiment the first and second guide means are arranged to provide coordinated pivotal movement of the back support relative to the base and intermediate support and linear movement of the intermediate support with respect to the base. The article of furniture may therefore be arranged to provide a so-called 'zero-wall' arrangement.

Preferably the back support provides at least part of a lever arrangement, movement of which lever arrangement also moves the intermediate member with respect to the base. In this way significant mechanical advantage may be achieved by utilising the back support of the item of furniture for example the backrest in a chair, as a lever to move the intermediate member with respect to the base, for example, in a forward linear direction in the case of a zero-wall chair. In this way the weight of the seated user's upper body can be distributed to actuate the lever to pivot the back support and thereby move the intermediate support forward. The back rest of an adjustable bed may be used in much the same way, typically by moving the backrest using an electrical actuator which will move the intermediate support with respect to the base to provide "zero-wall" functionality.

In preferred embodiments the second guide means provides a fulcrum about which the lever arrangement acts to move the intermediate member with respect to the base. In this way the fixed part of the second guide means defines a fulcrum point for providing the mechanical advantage (leverage) to move the intermediate support with respect to the base.

The intermediate support may be arranged to move in a linear motion with respect to the base, preferably in an inclined linear motion in a recliner chair so that as the intermediate support moves forward with respect to the base support, the intermediate support follows an upward inclined linear trajectory with respect to the base. In this way the above aspect of the present invention is particularly suited for use in a zero-wall recliner chair or sofa arrangement. In such an arrangement the seated user's body weight is balanced in the sense that the weight of the seated user's upper body is generally supported by the back support when being reclined, and the weight of the user's lower body is supported by the intermediate support, such that the arrangement is inherently counter-balanced during movement of the moveable parts. In adjustable bed embodiments it is envisaged that the movement of the intermediate support will preferably follow a non-inclined linear path.

In preferred embodiments the back support is pivotally connected to the intermediate support by at least one connecting lever, which connecting lever is pivotally connected to the intermediate support. This arrangement readily enables the back support to be fixedly secured, preferably in attachable/detachable manner, as is common with knock-down furniture, at one end of the connecting lever, with the other end of the connecting lever being pivotally connected to the intermediate support. This lever arrangement defines the pivot axis of the back support.

The connecting lever preferably includes the guide of the second guide means and accommodates the respective follower. In this way the guide and follower prevent the back support and connecting lever pivoting downwards under gravity with the article of furniture in its normal orientation. Thus, engagement of the guide and follower of the second guide means resists downward pivotal movement of the back support about its pivot axis. In other embodiments the connecting lever includes or is associated with the follower of the second guide means and the base support includes the respective guide.

Preferably the guide of the second guide means is curvilinear having one or more curved sections. In this way downward movement of the back support about its pivot axis effects movement of the intermediate support with respect to the base support.

Preferably the second guide means provides a fulcrum point for the connecting lever. In this way the fulcrum point, relative to the connecting lever or guide, moves along the length of the guide during pivotal movement of the back support about its pivot axis. This movement causes the pivot axis to move relative to the fulcrum point which, in arrangements where the follower is fixed in relation to the base, causes the pivot point to move along the path determined by the geometry of the guide.

In preferred embodiments each guide comprises a slot, groove, track or the like in which the follower(s) is/are located. This readily provides for the transmission of reaction loads between the various support elements.

In preferred embodiments the followers comprise rollers, bearings or the like. Preferably each follower is provided by a roller bearing, the outer element of which is located in a respective groove.

Preferably the base comprises a chassis on which the intermediate support is mounted. The present invention contemplates embodiments where the chassis is constructed partially or entirely of metal, wood or plastics material or a combination of two or more such materials. The base stands the article of furniture on the floor, and as such supports the weight of the furniture in addition to any load that is applied to the furniture. The base may be provided with castors, legs or the like as used in the furniture industry.

In preferred embodiments a seat support, in the case of a recliner chair or sofa, or an upper back support in the case of an adjustable bed, is fixed with respect to the intermediate support such that the seat or upper back support moves with the intermediate support during adjustment of the article of furniture.

The first guide means may include at least one guide associated with one of the base and intermediate support and at least one follower associated with the other of the base and intermediate support.

Preferably the guide(s) of the first guide means is/are associated with the intermediate support and the follower(s) is/are associated with the base, and the guide(s) of the second guide means is/are associated with the back support and the follower(s) is/are associated with the base, or vice versa. In this respect the followers of both the first and second guide means may be advantageously fixed relative to the base support structure such that the position of the followers remains stationary during adjustment of the chair, with the guides of the respective first and second guide means being moved with respect to followers during adjustment.

In one preferred embodiment the intermediate support includes a pair of lateral side panels that are spaced apart. The side panels may include the guides of the first guide means which accommodate the respective followers. Preferably, the guides of the first guide means are provided as respective slots in the side panels. In this way it is possible to readily provide guide slots in an accurate and repeated position in the respective side panels, particularly in items of furniture where the side panels are constructed of MDF or similar types of board material cut using CNC manufacturing methods.

In a preferred embodiment each side panel comprises a pair of slots which are inclined to guide the intermediate support upwards and forwards (in the normal orientation of the item of furniture) with respect to the base when the back support is pivoted downwards from an upright or partially reclined position.

Preferably the back support is pivotally connected to the respective lateral side panels. This readily enables the back support to function as a lever for driving the intermediate support in the manner as hereinbefore described when the back support is pivoted about its pivot axis.

In a preferred embodiment the intermediate support defines an outer support and the base defines an inner support. In this way it is possible for the aforementioned lateral side panels which constitute part of the intermediate support to be positioned on the outer side of the item of furniture with respect to the base support. In this way the moving parts of the furniture may be shielded by the lateral panels. The present invention also contemplates other arrangements, in particular where the intermediate support forms an inner support with respect to the base support which forms an outer support. Other embodiments are contemplated where the base support and associated components of the first guide means associated with the base are substantially located in a void between adjacent panels and/or other structural components of the item of furniture, such as the frame of a side aim which may be constructed with an internal cavity open at the end of the frame facing the base support (floor) to receive the components of the base support therein.

The article of furniture may comprise a recliner chair or a multiple seat, sofa or settee in which one or more of the seating parts functions as a recliner chair, for example, in a two seat sofa both seats may be constructed in accordance with the above aspect of the present invention to provide an arrangement in which both seats function as recliners.

The back support may comprise the backrest, or at least the frame for the backrest, of a recliner chair or adjustable bed. The intermediate support may comprise the moveable frame of the chair including the seat or seat support and/or arm or arms of the chair. The base support may comprise the floor stand on which the intermediate support is mounted for movement. It is to be understood of course that where reference is made to recliner chair in the context of the present invention, the term 'recliner chair' is to be construed to include not only chairs but also multiple seat sofas or settees where one or more of the seats has a recliner function, as previously mentioned.

In preferred embodiments first and second guide arrangements are provided at both lateral sides of the chair, or recliner seat of a multiple seat sofa, such that the, or each, seat is supported and guided by the respected guide arrangements on both sides thereof. In this way the seat support may be considered to be simply supported at respective positions on both lateral sides of the chair rather than supported on one side only as in a cantilever type arrangement. Thus, the above aspect of the present invention contemplates arrangements where the, or each, seat is supported and guided by respective first and second guide means on both lateral sides thereof.

The above and other aspects, features and advantages of the present invention will become apparent from the following description read in conjunction with the accompanying drawings, in which like reference numerals designate the same elements.

BRIEF DESCRIPTION OF THE DRAWINGS

The present invention will now be more particularly described, by way of example only with reference to the accompanying drawings, in which.

DETAILED DESCRIPTION OF THE PREFERRED EMBODIMENTS

Figure 2:
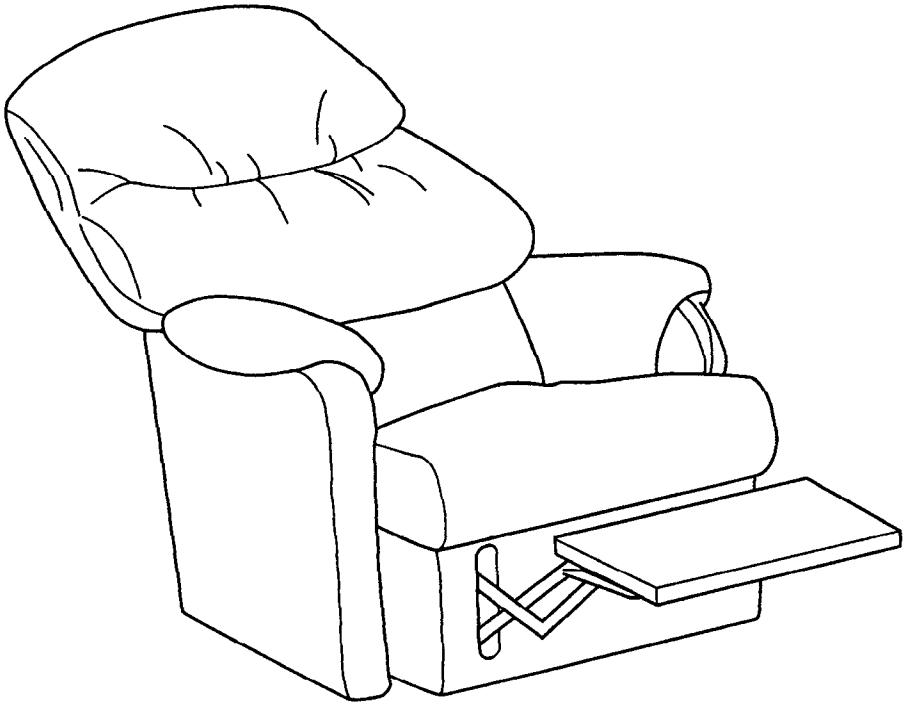
FIG. 2 is a similar view of the chair of FIG. 1 but in a reclined configuration.
Figure 1:
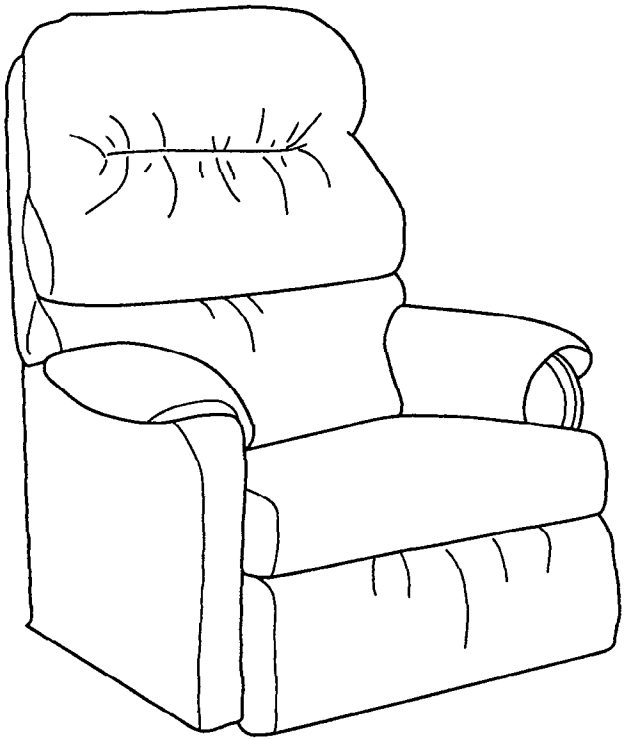
FIG. 1 is a perspective view of a known type of upholstered recliner chair in an upright configuration.

A recliner chair of the general type to which embodiments of the present invention relate is shown in an upright configuration in FIG. 1 and a reclined configuration in FIG. 2. The illustrated chair is of the upholstered type with a moveable backrest and footrest support, the latter of which projects forwards and outwards when deployed.

Referring now to FIGS. 3-13 which show the support arrangement and moving parts of a recliner chair arrangement according to an embodiment of the present invention.

Figure 3:
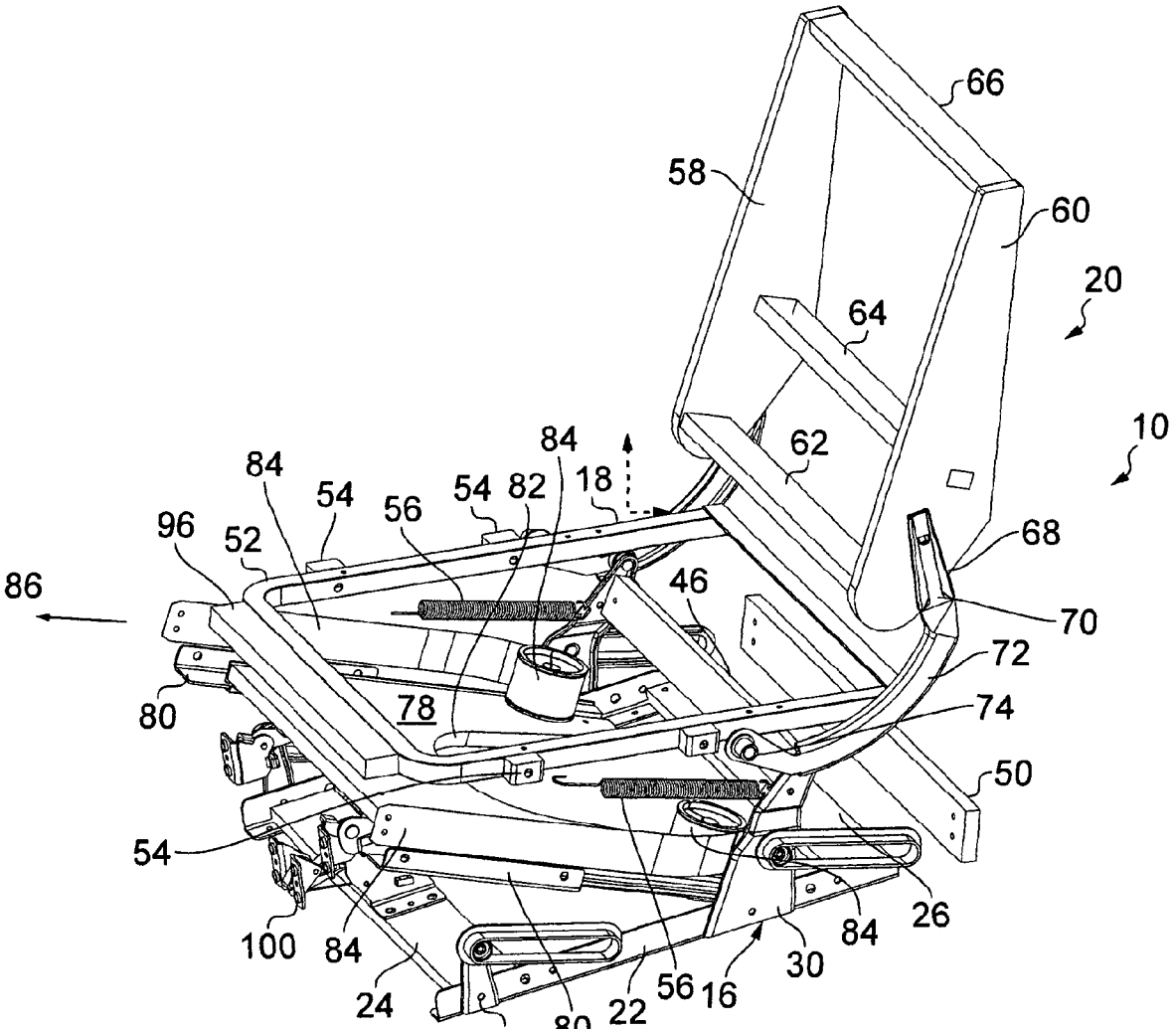
FIG. 3 is a perspective view from above of a recliner chair support arrangement and recliner operating mechanism according to an embodiment of the present invention.

FIG. 3 is a perspective view of the support and operating mechanism of a recliner chair arrangement according to an embodiment of the present invention. The support and operating mechanism 10 shown in FIG. 3 is the same as that shown in FIGS. 3-13 which various components removed in the series of drawings to reveal the detail of the support and operating mechanism. In FIG. 3, for example, the lateral side panel 12 shown in FIG. 6 and the footrest support 14 have been removed to reveal the detail arrangement of the internal parts.

Referring to the drawings a support and operating mechanism 10 for an adjustable recliner chair comprises a base support 16, an intermediate support 18, and a backrest or back support 20. The base support 16 constitutes the floor standing part of the chair and comprises a pair of lateral chassis legs in the form of L-Section elongate members 22 which extend parallel to each other on the lateral (left and right hand) sides of the chair. The chassis legs are preferably of metal, more preferably steel, construction and are connected together at the front and rear of the chair by front and rear cross-members 24 and 26, which are typically of wooden construction, for example MDF board or the like but of course could also be metal if desired. The cross-members 24 and 26 are shown in the drawing of FIG. 3 but omitted from the drawings of FIGS. 4 and 5 where it can be seen that a series of apertures 27 are provided at the front and rear of the chassis legs for receiving fixing screws or the like for attaching the cross-members to the respective chassis legs. The chassis legs 22 and cross-members 24, 26 constitute floor support members to which castors or the like may be attached for contact with the floor on which the chair is positioned.

The chassis legs 22 each carry a pair of upstanding members 28,30, including a triangular shape upstanding member 28 positioned towards the front of the chair and an upstanding member 30 positioned between the mid-point and rear of the chair. The upstanding member 30 also has a generally triangular configuration. In this embodiment both upstanding members 28 and 30 are constructed of metal, preferably steel, and are joined to the respective chassis legs 22 by welding or suitable fixing means such as bolts, screws or the like. A roller bearing 32 is mounted at the distal end or apex of the upstanding member 28. The upstanding member 30 carries a further roller bearing 34 partway along its length between the chassis rail and its distal end. The roller bearing is mounted on the outward facing side of the upstanding member 30 such that the bearing 34 lies in the same plane as the bearing 32 for engagement in respective raceway slots 36 and 38 provided in the lateral side panels 12 at appropriate spaced apart locations. The slots 36 and 38 constitute inserts, preferably of a plastics material such as nylon or glass reinforced nylon, and fit into correspondingly shaped slots in the respective lateral side panels 12 of the intermediate support 18. The slots 36 and 38 are inclined with respect to the bottom edge 40 of the respective side panels, such that movement of the side panels in a forward direction or the chair, as indicted in the direction 42 in FIG. 4, results in the movement of the side panels having an upward component which raises the bottom edge 40 of the side panels with respect to the respective chassis legs which lie parallel to the side panels 12 for supporting the chair on the floor on which it stands.

It is to be understood that in the drawings of FIGS. 3-5 and 7-13 the slot inserts 36, 38 are shown in their respective in-situ positions relative to the other illustrated components, that is to say where they would be positioned relative to the other parts of the adjustment arrangement if the respective side panels 12 which hold the inserts were present.

The rear upstanding members 30 are each provided with a perpendicular tab 44 on the inward facing side of the upstanding members. The tabs 44 provide a connection point for a further cross-member 46, as shown in FIG. 3, which is preferably constructed of an MDF type board material or the like and connected to the respective tabs by bolts, screws of other fixing means. The cross-member 46 stiffens the upper region of the upstanding members 30, the distal ends of which carry a further roller bearing 48. The roller bearing 48 is located in a plane off-set from the plane of the bearings 32 and 34. This is achieved by means of a slight crank or step in the upstanding support 30 between the position of the two bearings the support carries, namely bearings 34 and 48. In this way bearing 48 is positioned in a plane offset slightly towards the interior region of the chair. The reason for this offset will become apparent from the description that is to follow.

The lateral side panels 12 constitute part of an intermediate support structure of the chair, which intermediate support structure is moveable relative to the base structure by a guide arrangement which includes the bearings 32, 34 and respective slots 36 and 38, as previously described. In the context of the present invention the bearings 32, 34 and corresponding slots 36, 38 in the respective panels 12 constitute first guide means for determining the movement of the intermediate support with respect to the base support.

Figure 4:
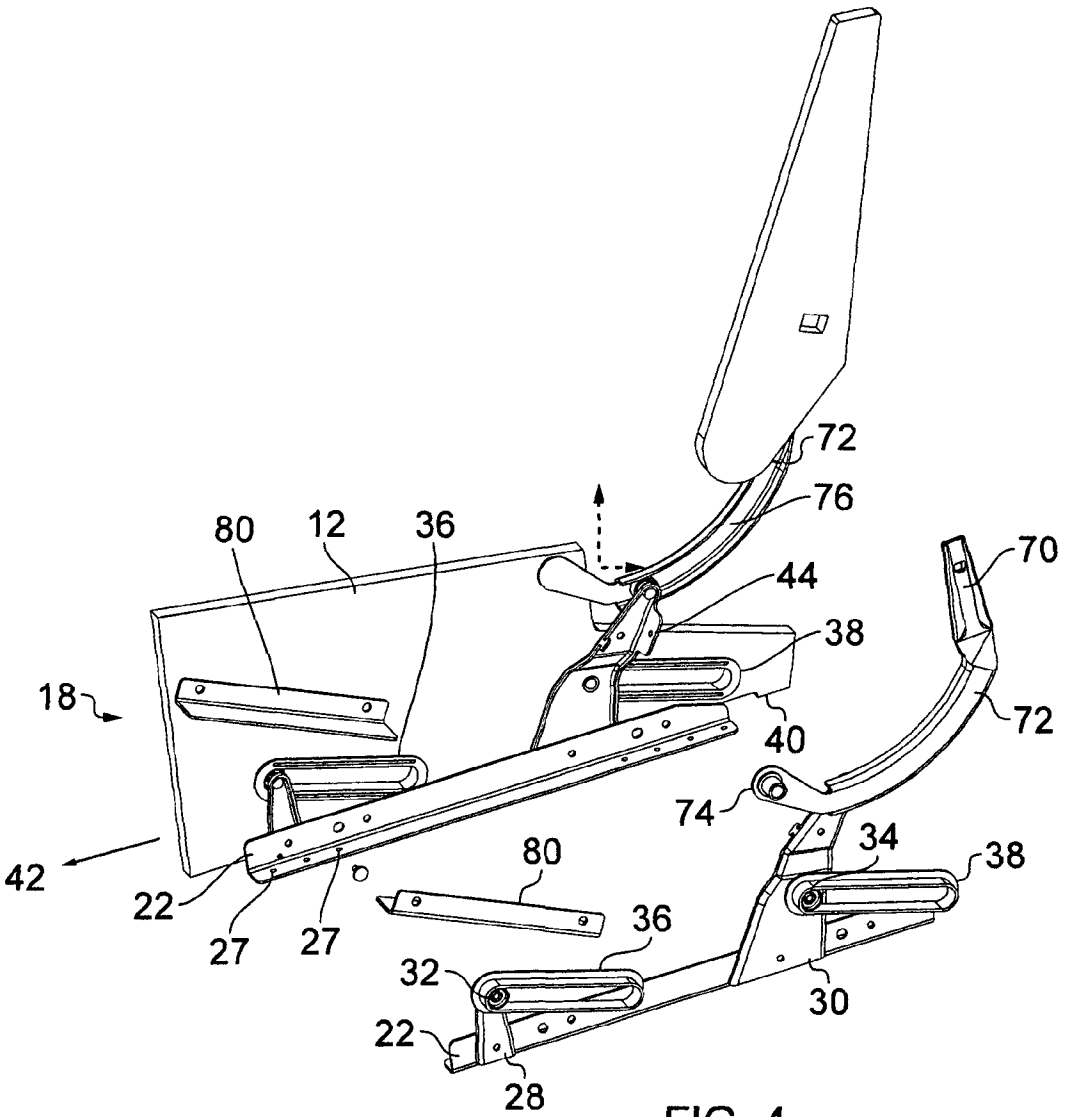
FIG. 4 is a view of the support and recliner arrangement and mechanism shown in FIG. 3 with many of the components parts omitted from the drawing.
Figure 5:
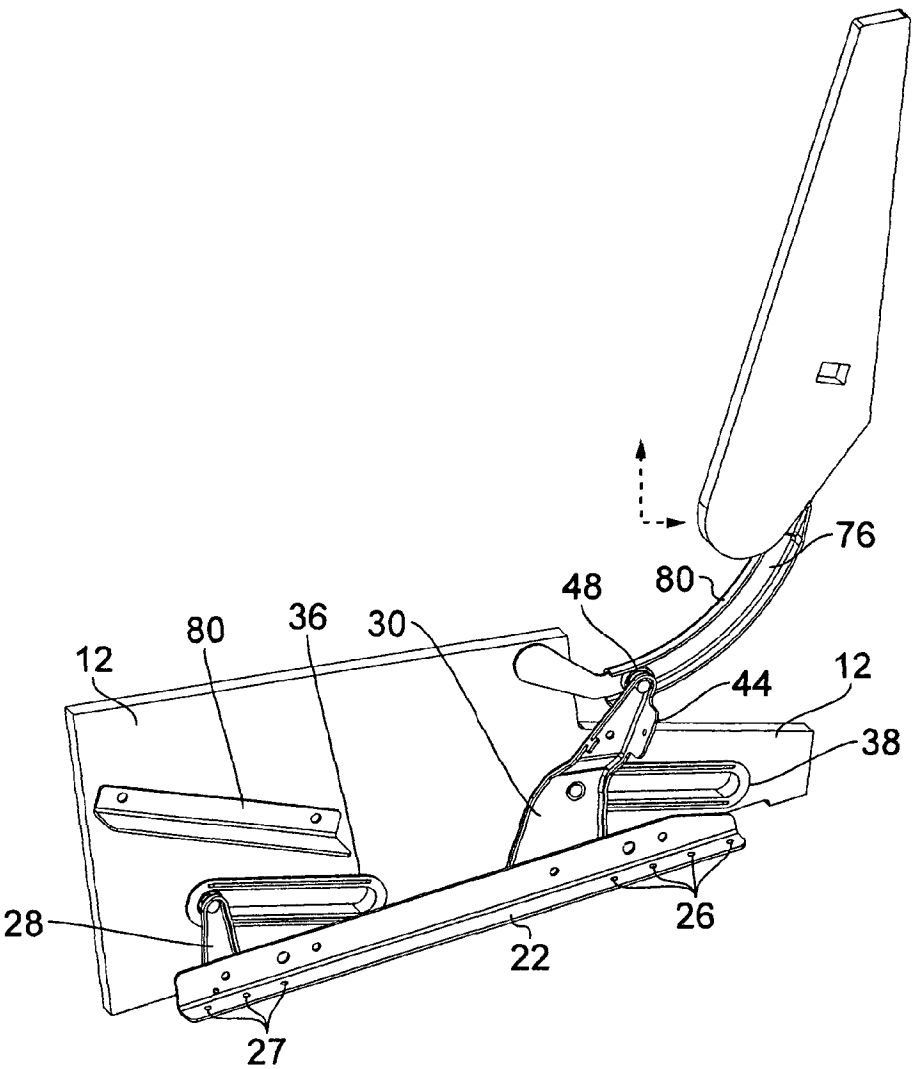
FIG. 5 is a detailed perspective view of one side of the recliner and support mechanism of the arrangement shown in FIGS. 3 and 4.
Figure 6:
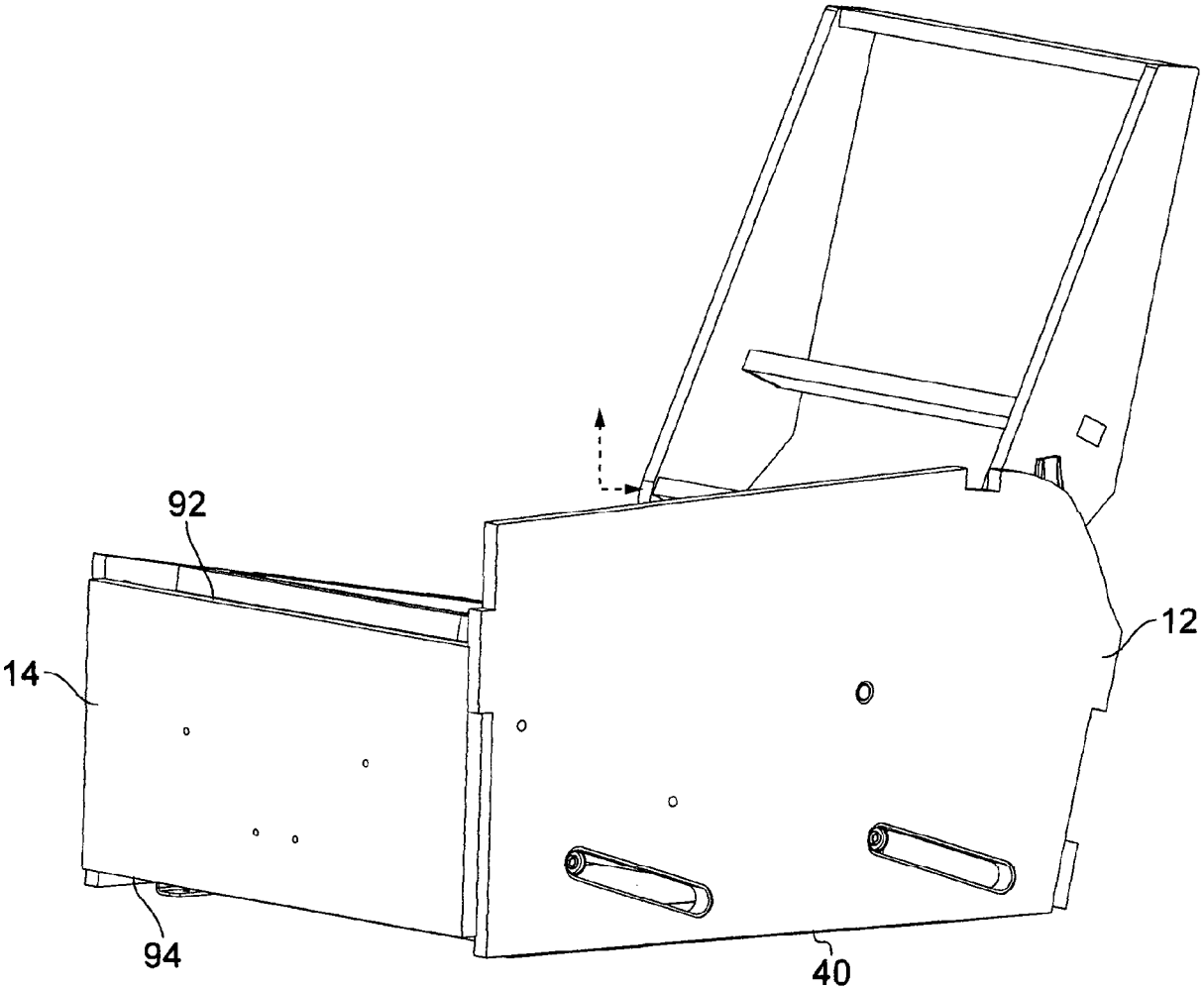
FIG. 6 is a perspective view of the chair of FIG. 3 from a different angle with the left-hand side panel and foot rest board shown.

As previously mentioned the left hand side panel 12 shown in FIG. 6 has been removed from the view of the support and operating mechanism of FIGS. 3, 4 and 5. However, it is to be understood that the respective lateral side panels 12 are connected together to form a rigid structure by means of a cross member 50 at the rear of the chair and a generally rectangular seat frame 52 which extends substantially along the length of the respective side panels and is fixed to the panels at a plurality of locations as best shown in FIG. 3.

The seat frame 52 comprises an outer rectangular frame, preferably of metal such as steel but embodiments are also contemplated in which the seat or frame is a wood or MDF structure. The seat frame supports the seat (not shown) of the chair in a manner well known to those skilled in the art. The lateral sides of the seat frame 52 are provided with a plurality of projecting mounting blocks 54 which connect the frame to the respective lateral side panels and space the lateral elongate parts of the frame from the side panels. In this respect it will be understood that the seat frame constitutes part of the intermediate support and being fixed with respect to the lateral side panels 12 moves in the same way as the side panels with respect to the base support. This movement is resisted by the provision of a pair of parallel coil springs 56 each of which is fixed at one end to a respective upstanding member 30 between bearing 34 and 48 and at the other end to a connector (not shown) on the inward facing surface of the respective side panels 12. The coil springs 56 resist movement of the intermediate support with respect to the base support by biasing the base and intermediate support to the position shown in FIGS. 3 to 5 with the roller bearings 32 and 34 positioned in the uppermost ends of the respective inclined slots 36 and 38.

The back support 20 comprises a generally rectangular frame 58 having a pair of lateral side panels 60 and cross members 62, 64 and 66 at respective lower, intermediate and upper end positions to create a box like structure as is well known in the art. The box frame backrest structure 58 is preferably constructed from MDF or other board like material with metal brackets 68 attached to the outward facing lateral sides towards the lower end of the backrest so that the backrest 58 can be slid on and off correspondingly shaped connectors 70 at the distal end of a pair of arcuate lever arms 72. The lever arms 72 are provided on both sides of the backrest and pivotally connect the backrest to the respective lateral side panels 12 by means of a pivot pin 74 at the opposite end of the lever to the connector 70. The pivot pins 74 on the respective levers 72 define the pivot axis of the backrest which is fixed in relation to the intermediate support by the pivot pins. Movement of the backrest about its pivot axis in constrained by a second guide means arrangement comprising the respective roller bearings 48 which run in respective slots 76 formed on the inward facing side of the respective lever arms 72, that is to say on the side of the lever arms that faces into the interior of the item of furniture. The guide slots 76 are provided along intermediate sections of the levers between the pivot point 74 and connectors 70 and are formed with a U-shape cross section such that the rollers engage the upper lip or wall of the U-section. Engagement of the roller bearings 48 with the respective upper lip part 80 of the U-shape cross section ensures that the seat back does not fall (pivot) downwards under its own weight about its pivot axis. The weight of the backrest is supported by the reaction at the bearings 48 with the upper engaging lip or wall 80 of the slots 76. In this respect it will be understood that the turning moment provided by the weight of the back support including the backrest frame and seat cushion etc, is reacted at the bearing 48 by an opposite moment due to the reaction force generated at the bearing 48 and carried by the base support structure. It is to be understood that the geometric relationship between the position of the various bearings 32, 34 and 48, the position of the pivot 74, the position and inclination of the slots 36 and 38 and the shape of the guide 76, in particular the upper lip surface which engages the bearing 48, is such that pivotal movement of the backrest drives the intermediate support forward and upward in a co-ordinated manner, coordinated with the movement of the backrest to ensure a natural progression between the different positions of the chair. Pivotal movement of the backrest about its pivot axis is constrained by the inter-engagement of the bearings 48 and the respective guide surfaces 80, such that as the support arms rotate the bearings follow the cam guide surfaces 80 of the support arms which generates a reaction force at the pivot pins 74 which drives the backrest and intermediate support relative to the base in the linear direction of the guide slots 36, 38.

It will be understood that if a force is applied to the backrest to rotate, that is recline, the backrest with respect to the intermediate support by turning the back support about its pivot axis, a component of the reaction force generated at the bearings 48 will cause the intermediate support to move upwards and forwards as previously described. Thus, with a seated user a reclining motion can be achieved by the user applying their upper body weight to the back rest to cause it to pivot about the backrest pivot axis to drive the intermediate support and associated seat cushion supporting the other part of the seated user's body weight upwards and forwards in an essentially counter-balanced motion. In this respect it will be appreciated that the user's own body weight is distributed in a counterbalanced manner to the extent that substantially half the user's body weight counterbalances the other half during a reclining movement, or a reverse movement which returns the chair from a reclined configuration back towards an upright configuration. In this respect it will be further understood that the pivot axis defined by the pivot pin 74 is preferably positioned at or near to the position of the seated user's hips to optimise the counter balanced operation of the recliner chair to provide a recliner chair which requires minimum effort on the part of the seated user to move between its reclined and upright positions.

The inclined and forward (upwards) movement of the intermediate support when the seat back is reclined gives the chair, according to this embodiment of the present invention, the characteristics of a "zero wall" type of chair since the pivot point of the seat back moves forward towards the front of the chair and away from any obstruction that may otherwise occur if the chair were not constructed with this particular design function. It will be understood by those skilled in the art that as the back rest pivots downwards about its pivot axis the position of the fulcrum, as defined by the bearings 48, moves with respect to the centre of pressure applied to the back rest by the seated user when reclining the chair.

In the embodiment shown in FIGS. 3 to 13 the illustrated recliner chair forms part of a two-seater sofa or settee in which the second seat (not shown) is substantially a mirror image of the illustrated seat with the plane of symmetry being arranged down the plane of the lateral side panel, that is to say the right hand side panel as would be the case from the datum of the seated user in the left hand part of the two-seater sofa illustrated in the drawings. It will be appreciated therefore that the lateral side panels 12 will be different in this embodiment since the left hand lateral side panel, as illustrated in FIG. 6, will have greater depth in order to accommodate a side aim of the item of furniture. It will be understood that a recliner chair arrangement would require an arm on both sides and therefore the right hand lateral panel 12 would in such an embodiment be replaced by one similar to the left hand lateral panel shown in FIG. 6.

The present invention also contemplates embodiments where the article of furniture is an adjustable bed having a base support, an intermediate support and a back support, the latter being provided by the backrest and head supporting part of an adjustable bed. Embodiments of an adjustable bed are described in detail below.

The drawing of FIG. 3 also shows part of the support and operating mechanism for a footrest. The footrest board 14 shown in FIG. 6 has been omitted from FIG. 3 so as to reveal in detail the various parts of the support and operating mechanism. The footrest board 14 is pivotally connected, in a manner to be described in greater detail below, to an ottoman board arrangement 78 which is slideable in a drawer-like manner on inclined guide tracks 80 secured to respective inward facing sides of the left and right hand lateral side panels 12. The position of the guide tracks 80 is shown more clearly in the drawings of FIGS. 4 and 5, without the movable ottoman board 78. The inclined guides 80 constrain the board to follow an inclined translational movement as defined by the orientation and inclination of the guides 80. Engagement means (not shown) are provided along the respective lateral edges of the board 78 to engage the guides 80. The guides 80 are preferably constructed of metal, most preferably steel, whereas the board 78 is preferably MDF which is scalloped at 82 to reduce weight.

A pair of so-called constant force springs 84 are provided for biasing the board 78 outwards from the internal region of the chair in the direction indicated by 86 in FIG. 3. The constant force springs provide the actuation force necessary to deploy the board 78 outwards in the direction 86. The constant force springs 84 each comprise a coil of strip material which is biased against unwinding so that when the free end of the strip is unwound, the bias force of the spring is such to reel in the payed out part of the elongate strip. It will be appreciated by those skilled in the art that this type of construction is used in the construction of steel coil type tape measures and the like. In the present embodiment the respective coils 84 are secured to the ottoman board on the upper facing surface of the board towards the rear end thereof. The free ends of the strip 86 are secured to the inward facing surface of the respective lateral side panels 12. The coils 84 are secured towards the edge of the panel 78 adjacent to the side panels 12, such that the length of the strip that is deployed from the coil essentially runs parallel to the panels 12. Thus, the tension in the spring urges the ottoman panel 78 outwards in the direction 86. The extent of movement of the board 78 is determines the maximum payed out length of the coil spring which occurs when the board is in its retracted position as shown in FIG. 3, in which position the board is retained by means to be described below. The board 18 therefore acts as a drawer-type structure which is biased open but retained in its retracted, or closed, position by a latch or other retaining means as is well known to those skilled in the art.

Figure 7:
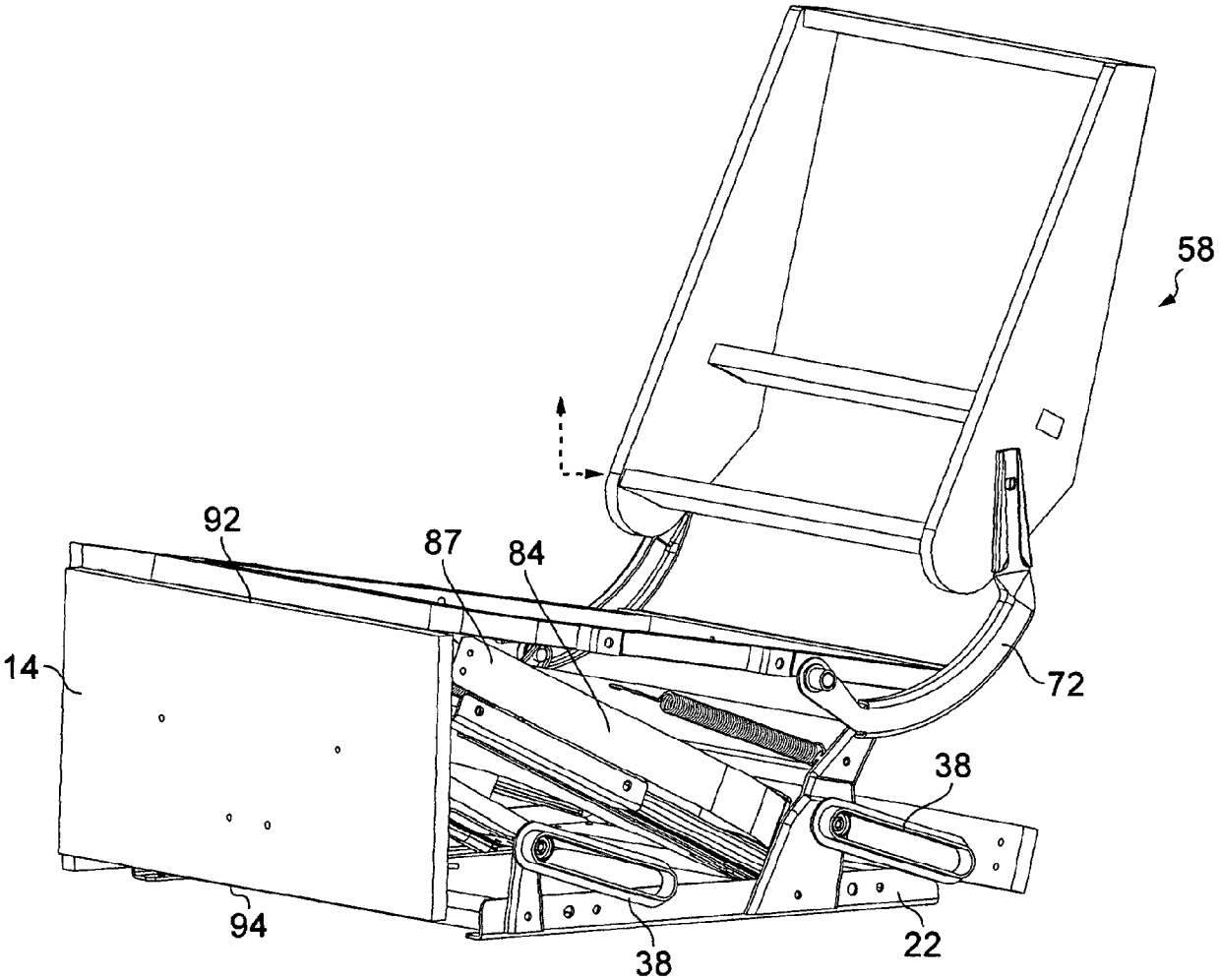
FIG. 7 is a perspective view similar to that of FIG. 6 with the left hand side panel removed to reveal the detail of the support and recliner mechanism.

As previously mentioned the footrest board 14 is shown in its retracted position in FIGS. 6 and 7. In FIG. 7 the lateral side panel 12 is removed from the drawings to reveal the detail of the support and operating mechanism of the chair. In FIG. 7 the free end 87 of the constant force spring can be clearly seen, although of course the end is secured to the lateral panel 12 in the actual arrangement. Further detail is revealed in the drawing in FIG. 8 where the footrest board 14 is removed from the drawing for the purpose of illustrating the interior of the operating mechanism. In this drawing it can be seen that the ottoman board 78 is provided with a pair of hinges 90 secured on its underside, with one part of the hinge being attached at the forward edge of the board 78. The other part of both hinges connects to the rear face, or the underside, of the footrest board 14 to pivotally connect the footrest board 14 to the forward edge of the ottoman board. The footrest board 14 is pivotally connected in a position substantially mid-way between its upper edge 92 and lower edge 94, that is with the upper and lower edges being defined in the normal upright configuration of the chair when the footrest is retracted, as shown in the drawings of FIGS. 6 and 7. Pivoting of the footrest board 14 from its vertical configuration shown in FIG. 6 to its more general horizontal deployed configuration is achieved by securing flexible material between the upper edge 92 of the footrest board and the seat frame 52, preferably to the front end member 96 of the seat frame shown in FIGS. 3 and 8. Webbing or the like (not shown) may be secured to the transverse member 96 at the front of the seat frame and secured in the region of the top edge 92 on the rearward/underside of the footrest board 14 so that when the board 78 moves forward to deploy the footrest board a turning moment is created by tensioning of the webbing or similar material to turn the upper edge 92 about its central pivot axis. It will be appreciated that by pivoting the footrest board near or about its midpoint between upper and lower edge 92 and 94 retraction of the footrest can be easily achieved by the seated user applying gentle pressure by their heels to the board in the region of the lower edge 94. This will turn the footrest board from a horizontal to an inclined orientation so that further lowering of the user's lower legs will cause the board to retract substantially towards the position shown in FIG. 7, with the weight of the seated user's lower legs acting against the biasing force of the constant force springs 84.

Figure 10:
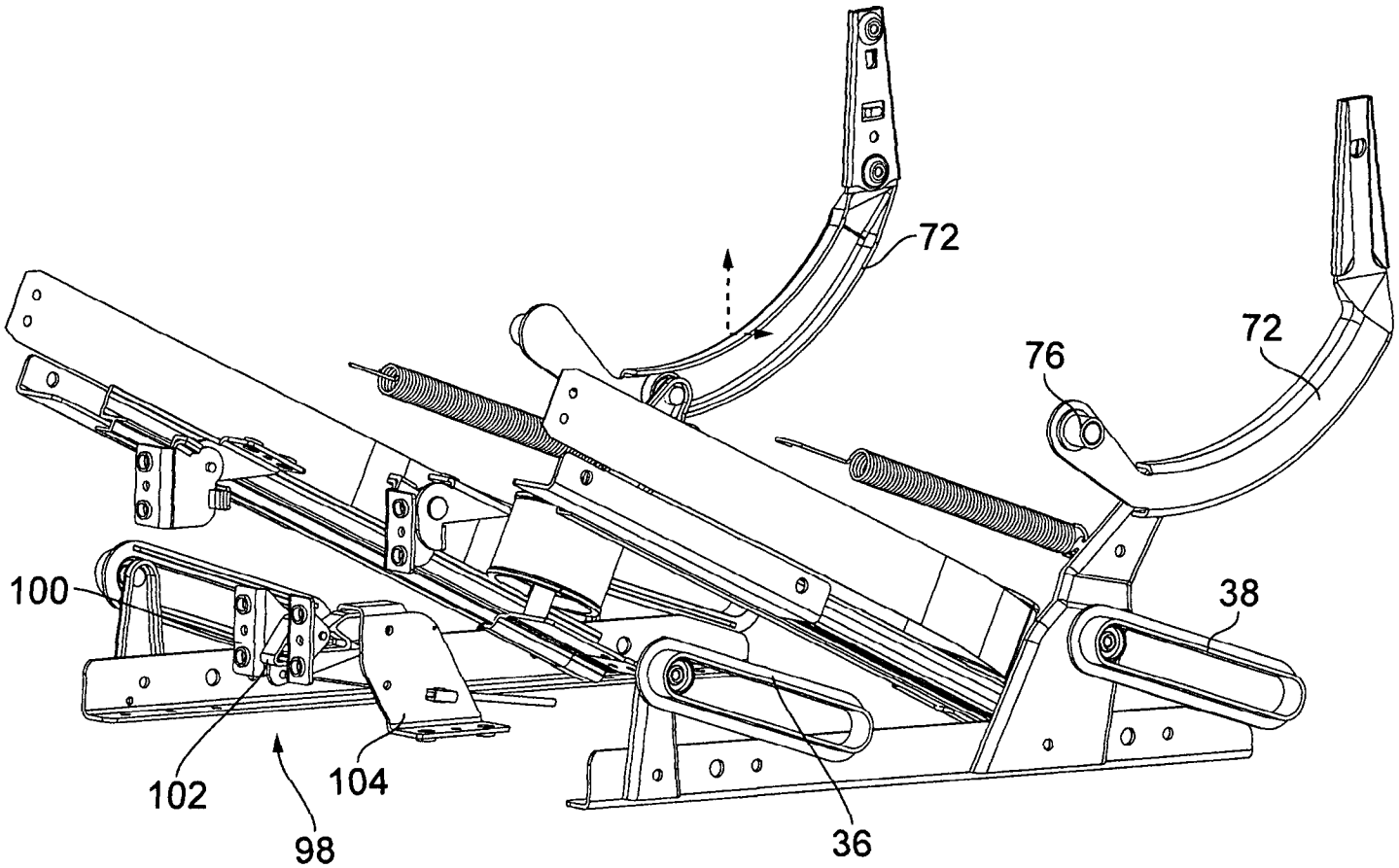
FIG. 10 is a view similar to that of FIG. 9 with the backrest frame, seat support panel and footrest panel removed to show further detail.

The footrest board 14 is held in its retracted position by means of a latch arrangement, as can best be seen in FIG. 10.

In FIG. 10 a latch arrangement 98 includes a bracket 100 mounted on the underside of the footrest board 14 (not shown in FIG. 10) which carries a pin (not shown) which is engaged by a latch lever 102 mounted on a bracket 104 secured to the cross-member 24 (also not shown in FIG. 10). The latch 102 is biased to its closed position to lock the footrest board 14 in its retracted position, as shown in FIG. 7. As is well known in the art, remote operation of the latch lever 102 is provided by a cable release such as a bowden-cable type arrangement which is operated remotely by the user, preferably from the side of the chair.

In a recliner chair according to the illustrated embodiment the footrest can be operated independently of the recliner part of the chair, such that the footrest can be deployed from its retracted vertical position to a substantially horizontal position independently of the reclining movement of the chair. This configuration is often referred to as the "TV position". In a powered embodiment a single electrical linear actuator ma be provided first to drive the footrest outwards to its deployed position so that the chair adopts the "TV position", with further extension of the actuator driving the intermediate support forward and upward relative to the base with the back rest support following due to the guide and pivot arrangement hereinbefore described. This can be readily achieved in powered embodiments in which a single linear actuator is secured at one end to part of the base structure and at its other end to the footrest or footrest deployment/retraction arrangement such as the ottoman board 78 in the illustrated embodiment.

Figure 8:
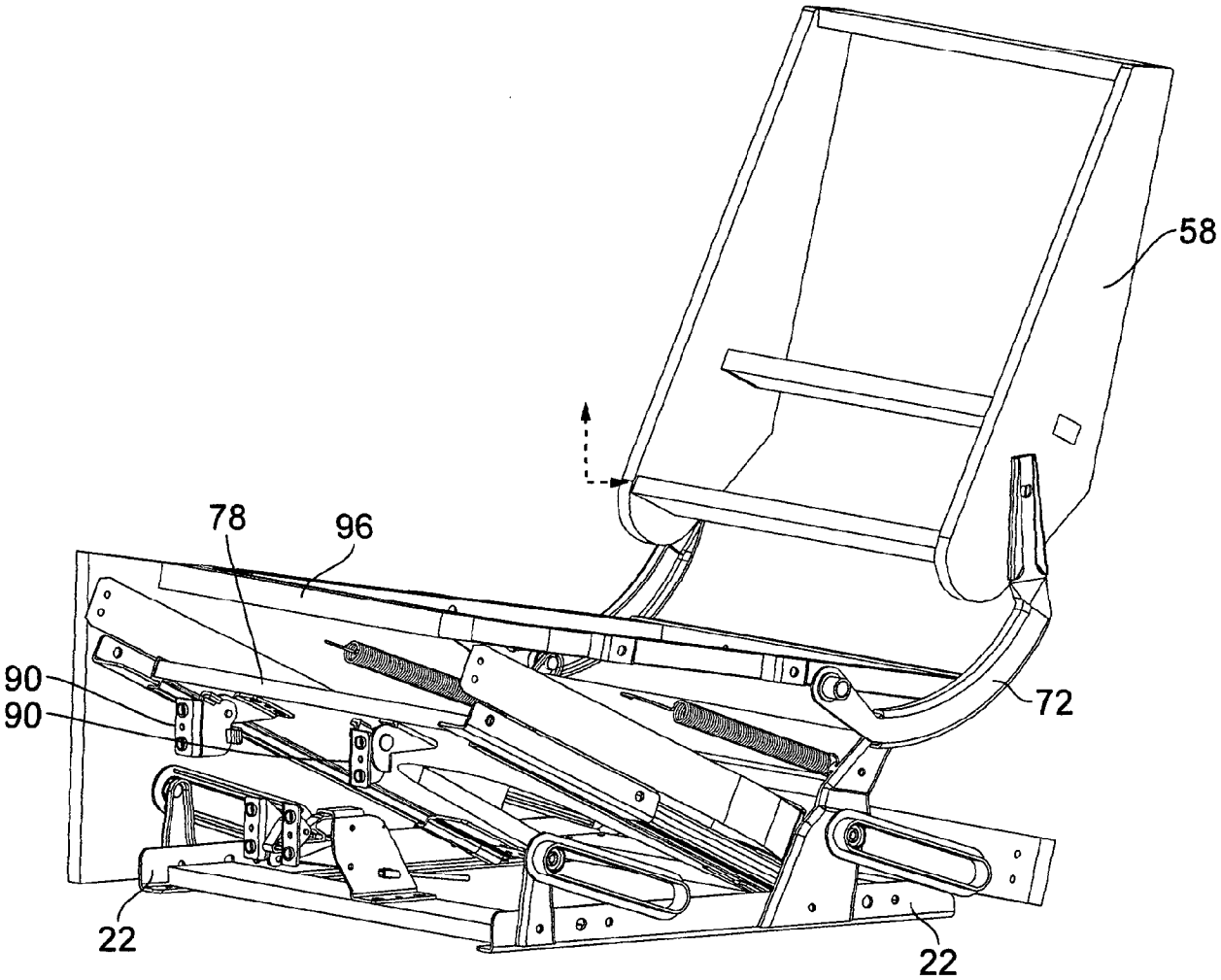
FIG. 8 is a view similar to that of FIG. 7 but with the front footrest panel removed to reveal further detail of the support and recliner mechanism.

Although the forgoing description refers mainly to the drawings of FIGS. 3 to 6, it will be understood that the drawings of the FIGS. 3 to 13 are various views of the same embodiment, with the view of FIG. 7 being similar to that of FIG. 6 with the lateral side panel 12 removed to reveal the detail of the support structure and operating mechanism of the chair. In the drawing of FIG. 7 it will be understood that the guide slots 36 and 38 are shown schematically since they are fixed within correspondingly shaped slots in the removed side panels, and they are shown orientated as they would be if the lateral side panels were present. In FIG. 8 the drawing of FIG. 7 is further modified by the removal of the front footrest panel 14 so reveal further detail of the chair.

Figure 9:
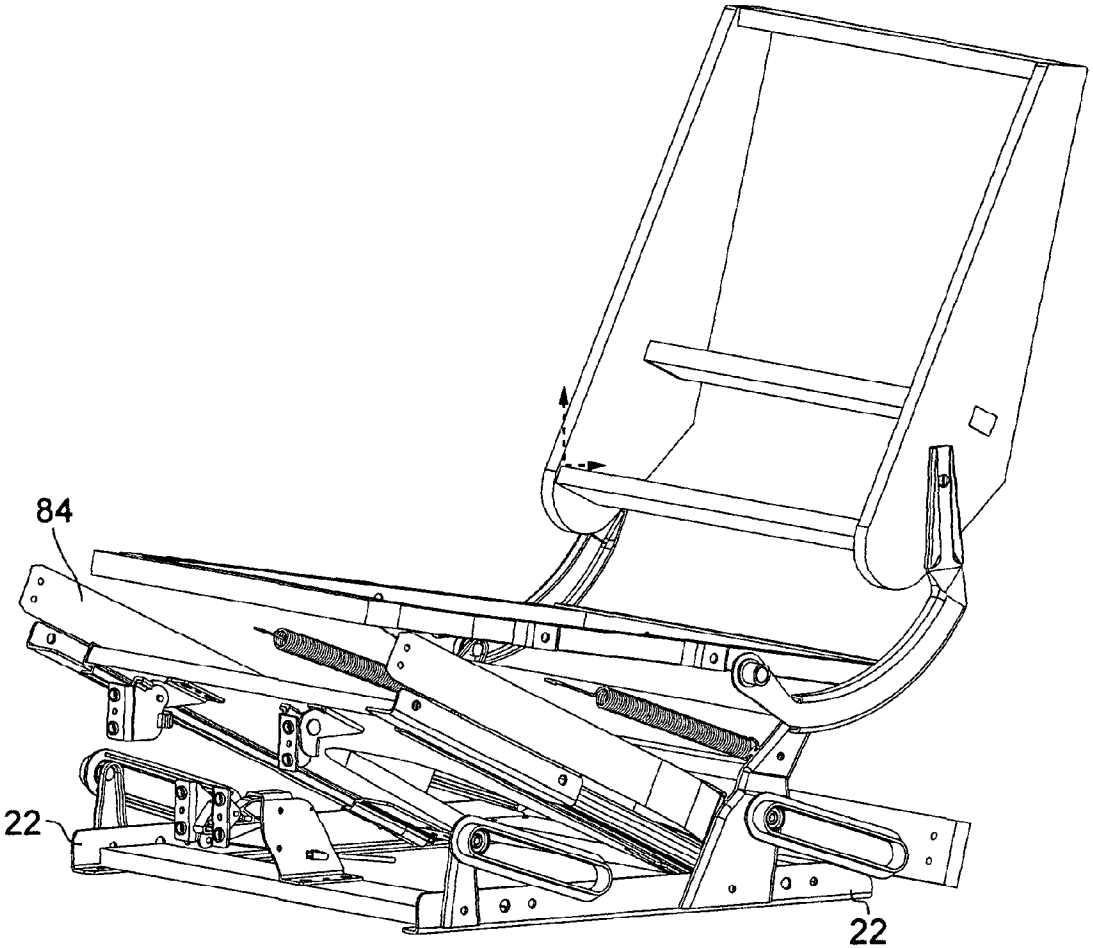
FIG. 9 is a view similar to that of FIG. 8 but with both left and right hand side panels removed.

In the drawing of FIG. 9 (right hand side) the other lateral side panel 12 has been removed from the drawing of FIG. 8 but additional detail has been added, including the second of the two constant force springs 84.

In the drawing of FIG. 10 further detail has been removed from the drawing including the back support 20, which in this embodiment is detachably attachable in the sense that the back support may be removed for transportation and storage purposes in a manner well known in the art of knock-down furniture construction. In the drawing of FIG. 10 the seat frame support 52 has also been removed from the drawing, as well as the board 78.

Figure 11:
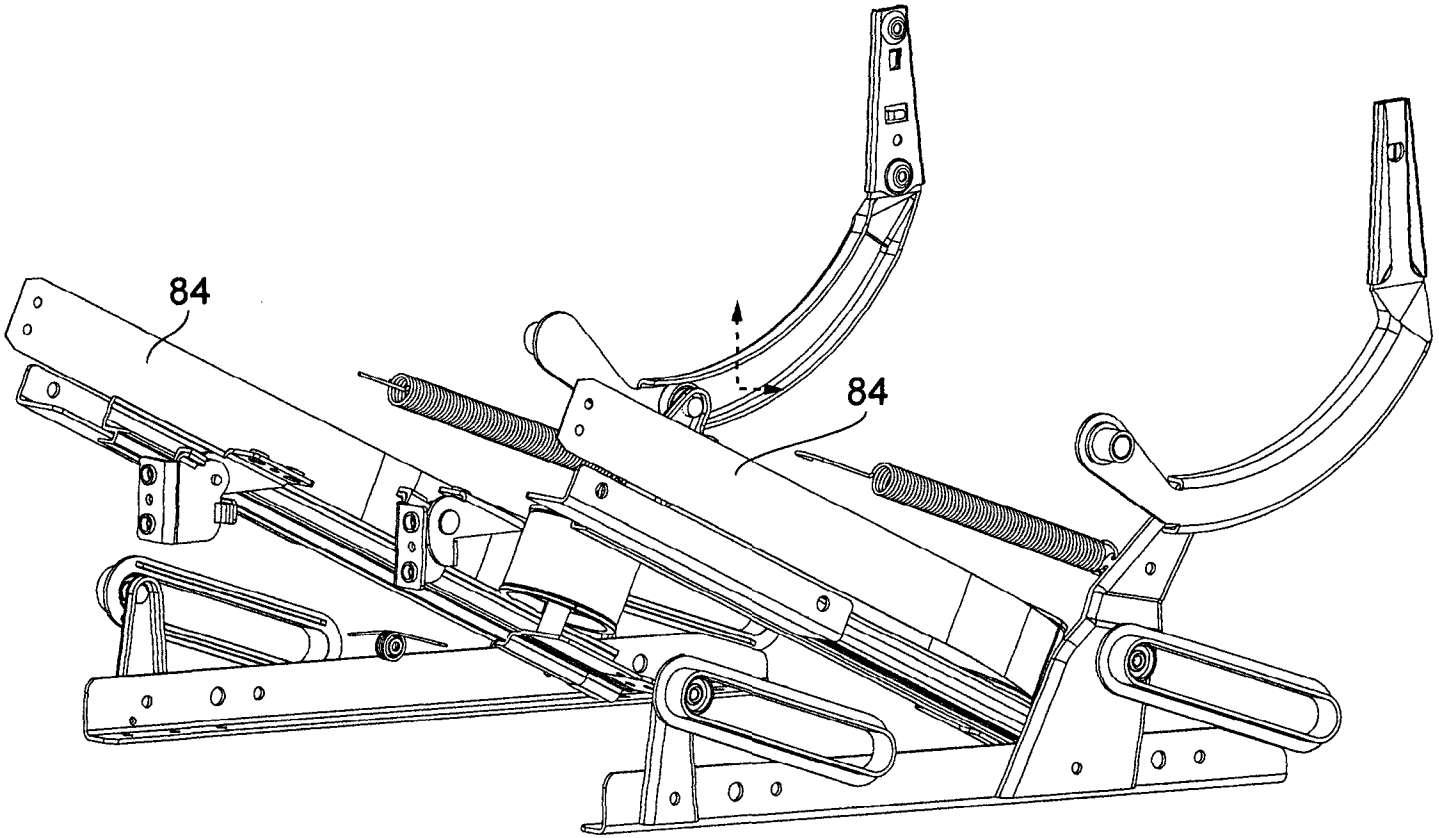
FIG. 11 is a detailed perspective view similar to FIG. 10 with further components removed including the footrest catch and its associated support.
Figure 12:
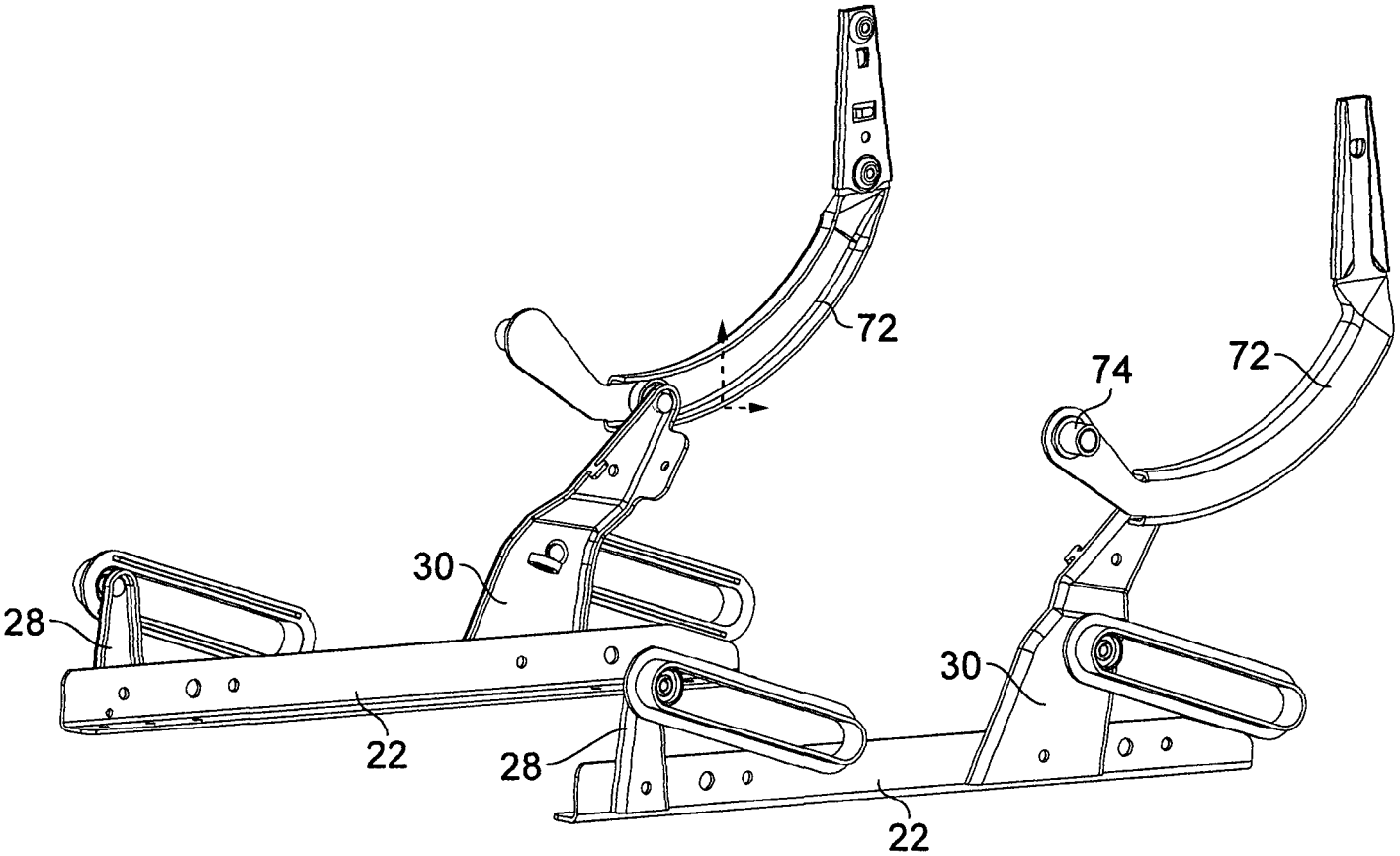
FIG. 12 is a view similar to FIG. 11 with most of the components removed showing the detailed spatial arrangement of the various guides associated with the support and recliner mechanism of the embodiment of the recliner chair shown in FIGS. 5 to 13.

In the drawing of FIG. 11 the latch arrangement has been removed, and in the drawing of FIG. 12 the actuator mechanism for the footrest is removed so that only the major components of the base support associated guide slots 34 and 38 and support levers 72 are shown.

Figure 13:
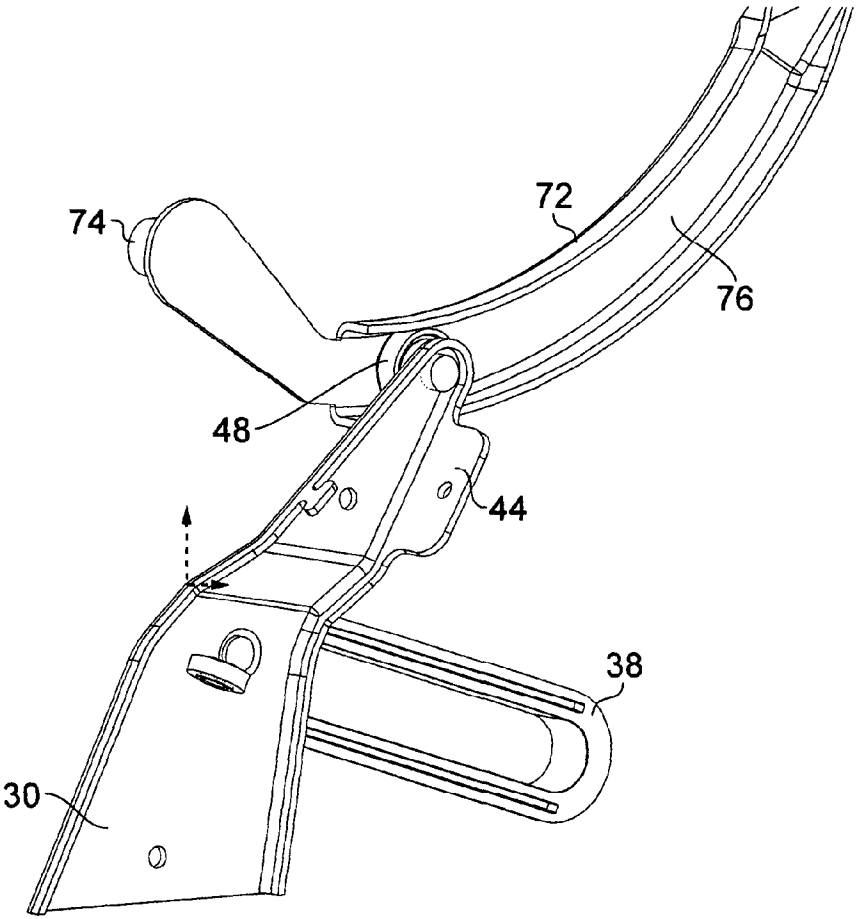
FIG. 13 is a detailed perspective view of the region indicated at X in FIG. 12.

FIG. 13 shows in close-up the detail of the second guide means for guiding the movement of the backrest support, including the detail of the upstanding support 30, the roller bearing 48, pivot pin 74, lever arm 72 and U-section guide slot 76 on the right hand side of the chair as illustrated in FIG. 5.

Figure 14:
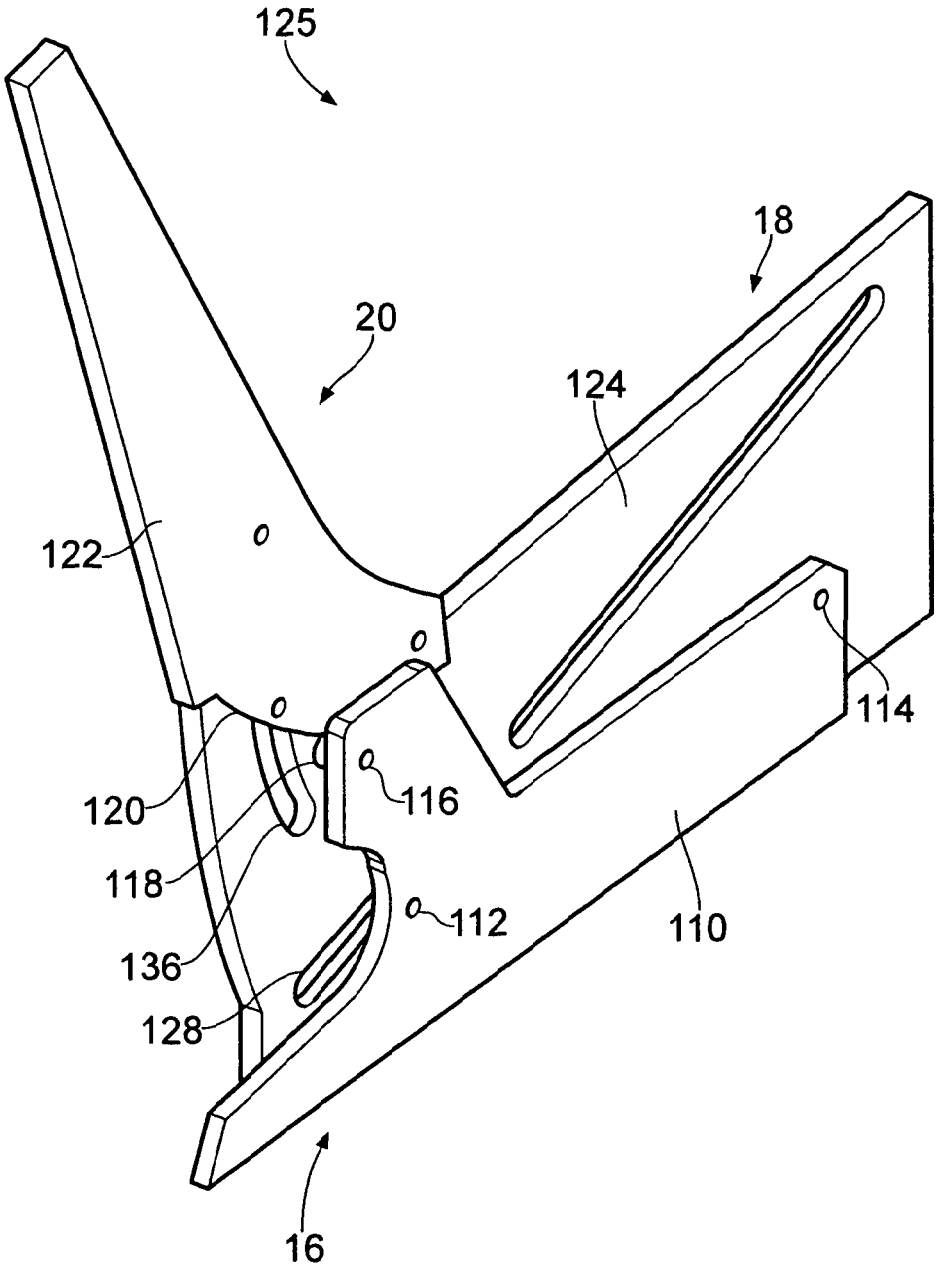
FIG. 14 is a perspective view of part of a support and adjustable operating arrangement for a recliner chair constructed in accordance with a second embodiment of the invention.

Referring now to FIG. 14 which shows part of a recliner chair arrangement according to a second embodiment of the invention. The view of FIG. 14 is similar to that of FIG. 5 in that it shows one side of a support and operating mechanism for a recliner chair, sofa or the like. The general principle of construction and operation of the arrangement shown in FIG. 14 is substantially the same as that in the previous embodiment in that there is provided a base support 16 an intermediate support 18 and a back support 20. In this embodiment the L-section chassis legs 22 are replaced by a planar support panel 110 having a sphinx-shape profile which, on the other side of the panel to that shown in the drawing of FIG. 14 carries three roller bearings at three positions indicated 112, 114 and 116 in the drawing. The roller bearing 118 rotatably mounted on the other side of the panel at 116 is equivalent to the bearing 48 in the previous embodiment but instead of engaging the upper lip of the guide 76 the bearing 118 is engaged by a curved surface 120 on the lower part of the back support arm 122 which is rotatably connected to the side panel 124. The side panel 124 constitutes part of the intermediate support and is equivalent to the panel 12 in the previous embodiment.

Figure 15A:
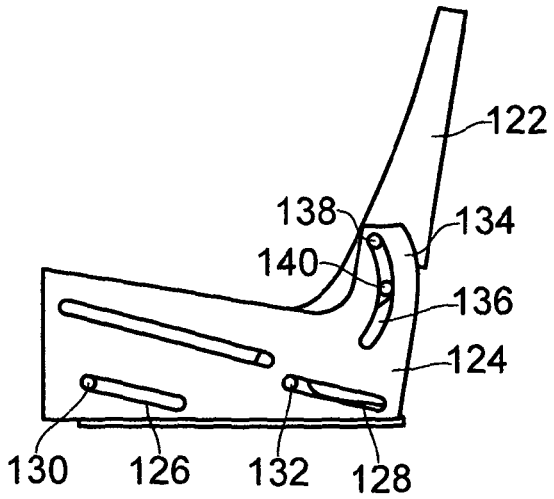
FIGS. 15*a* to 15*e* comprise a series of side views of the arrangement shown in FIG. 14 in various positions of adjustment.
Figure 15B:
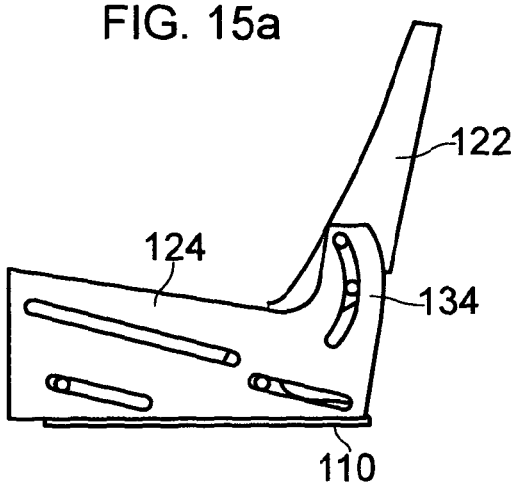
Figure 15C:
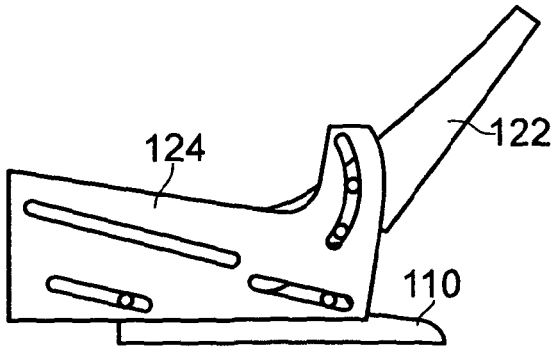

Referring now to FIGS. 15*a* to 15*e*, and in particular to FIG. 15*a* which shows a side view of the support and operating arrangement of FIG. 14 as viewed in the direction indicated 125 in FIG. 14. In the side view of FIG. 15*a* it can be seen that the side panel 124 comprises a pair of inclined parallel and offset slots 126 and 128 which are equivalent to guide slots 36 and 38 in the previous embodiment. The guide slot 126 accommodates a roller bearing 130 which is rotatably mounted to the base support member 110 at 114. The guide slot 128 accommodates a roller bearing 132 which is rotatably mounted to the support member 110 at 112. In this respect it will be understood that the three roller bearings 118, 130 and 132 are equivalent to the bearings 48, 32 and 34 respectively in the previous embodiment.

The side panel 124 differs slightly from the side panel 12 of the first embodiment in that it includes an upstanding portion 134 at the rear of the panel which includes a radial slot 136 which accommodates a pair of roller bearings 138, 140 rotatably mounted on the side of the back support arm 122. The back support arm 122 is therefore rotatable relative to the intermediate support panel 124 about an axis coincident with the centre of curvature of the slot 136.

The support and operating arrangement of the second embodiment of the present invention is particularly suitable for manufacture from board material such as MDF or similar high strength low cost material. The base support member 110 is preferably manufactured from such a board by CNC machining the profile, followed by attachment of the roller bearings at the appropriate locations. Similarly the planar side panel 124 is preferably also manufactured by CNC machining to include the guide slots etc. The back support arm 122 is preferably also manufactured in this way. It is to be understood that a recliner chair would include two such support and operating arrangements shown in FIG. 14 spaced apart by a distance determined by the width of the seat of the chair. In preferred embodiments the intermediate support panel 124 is arranged on the outside of the chair with the base support member 110 on the inside, however embodiments are envisaged with the base support 110 on the outside and the intermediate support panel 124 on the inside.

Figure 15D:
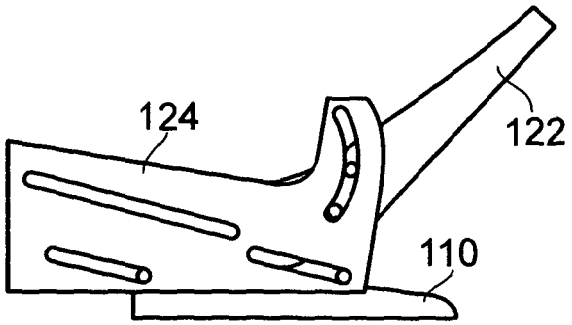
Figure 15E:
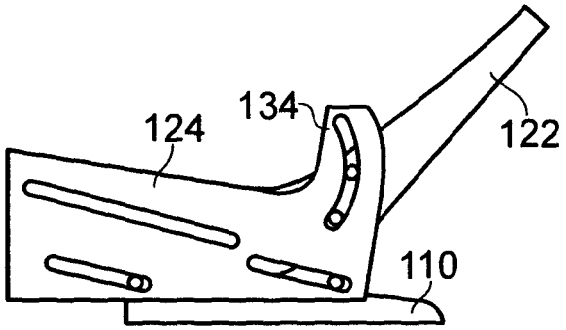

FIGS. 15*a* to 15*e* show the support and operating arrangement of FIG. 14 in various positions from a fully upright position in FIG. 15*a* to a fully reclined position in FIG. 15*d*, with intermediate positions being shown in 15*b, c* and *e*. As in the first embodiment of the invention the three main supports, base, intermediate and back, cooperate in such a way that the movement of the back support arm about its pivot axis is coordinated with the movement of the intermediate support, with respect to the base, a linear upwards and forward direction when the back support arm is pivoted downwards. The movement of the support and operating arrangement of the recliner chair in the second embodiment is substantially similar to that of the first embodiment in that the reaction forces generated at the bearing 118 and guide surface 120 urge the intermediate support forward and upwards as previously described with respect to the first embodiment.

Figure 16A:
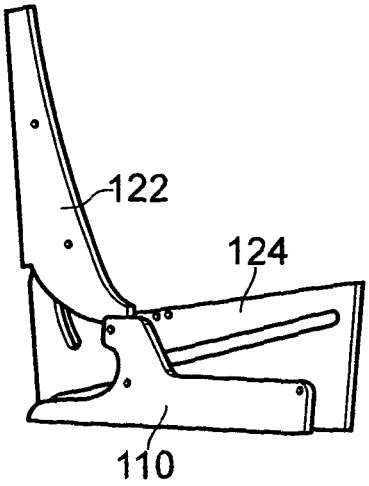
FIGS. 16*a* to 16*d* comprise a series of side views of the arrangement shown in FIG. 14 when viewed from the side shown in FIG. 14.
Figure 16B:
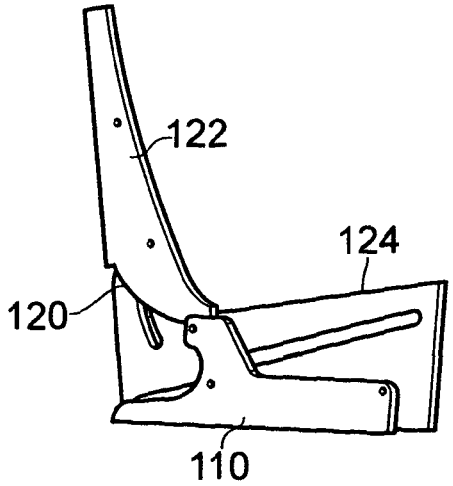
Figure 16C:
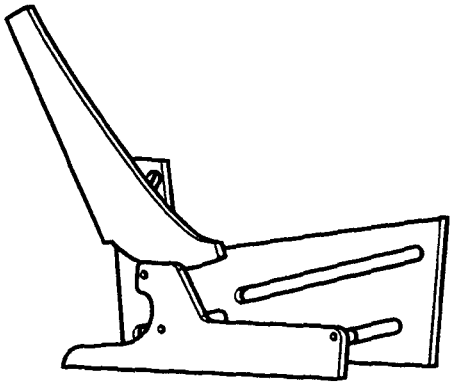
Figure 16D:
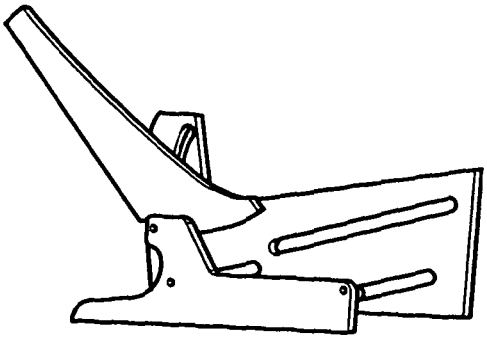

The movement referred to in FIGS. 15*a* to 15*e* is shown from the other side of the support and operating arrangement in FIGS. 16*a* to 16*d*, starting from the fully upright position in 16*a*, progressively through to the fully reclined position shown in FIG. 16*d*.

Figure 17A:
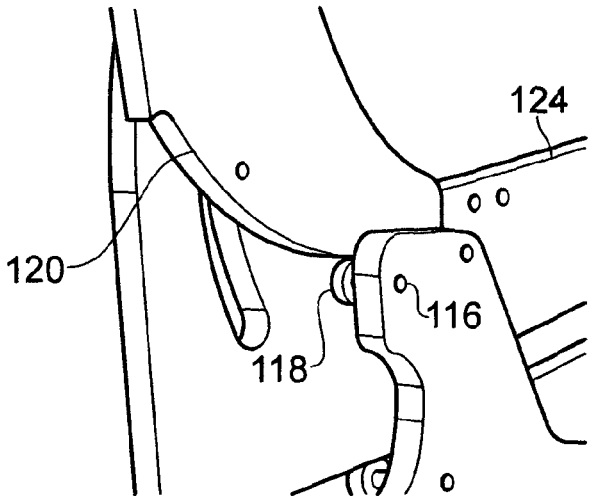
FIGS. 17*a* to 17*c* comprise a series of perspective detail views of part of the arrangement shown in FIG. 14.
Figure 17B:
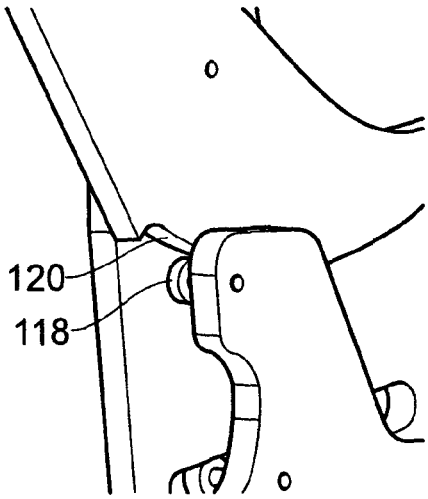
Figure 17C:
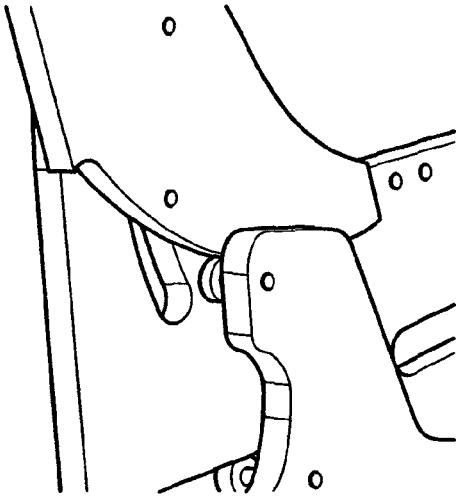

Referring now to the sequence of detailed perspective views of FIGS. 17*a* to 17*c*, which show the detail arrangement in the region of the second guide means towards the rear of the chair where the back support arm 122 is supported about its axis by the roller bearing 118. The shape and curvature of the cam profile guide surface 120 determines the relative motion of the moveable parts 122 and 124 both with respect to each other and the base support 110. The curvature of the guide surface 120, like the guide slot 76, is determined such that during the pivotal movement of the back support sufficient reaction forces exist between the bearing 118 and the guide surface 120 that the downward pivotal movement of the back support causes the intermediate support to move forwards and upwards as determined by the guide slots 126, 128 and respective bearings 130 and 132. It is to be understood that the curvature of the guide surface 120, and for that matter the guide slot 76 and in particular the upper lip 80, is important to the correct functioning of the support and operating arrangements described.

FIGS. 17*a* to 17*c* show the respective parts of the support and operating arrangement when the recliner chair is in the upright configuration (FIG. 17*a*) in a reclined configuration (FIG. 17*b*) and an intermediate position (FIG. 17*c*).

A further embodiment of a support and operating mechanism 10 for an adjustable recliner chair is illustrated in FIGS. 18-21. The embodiment of FIGS. 18-21 is substantially identical to the embodiment of FIGS. 3 to 13, with modifications to the footrest support and operating mechanism as will be described in detail below. In the drawings of FIGS. 3-13 and 18-21 the same reference numerals are used for the same component parts.

Figure 18:
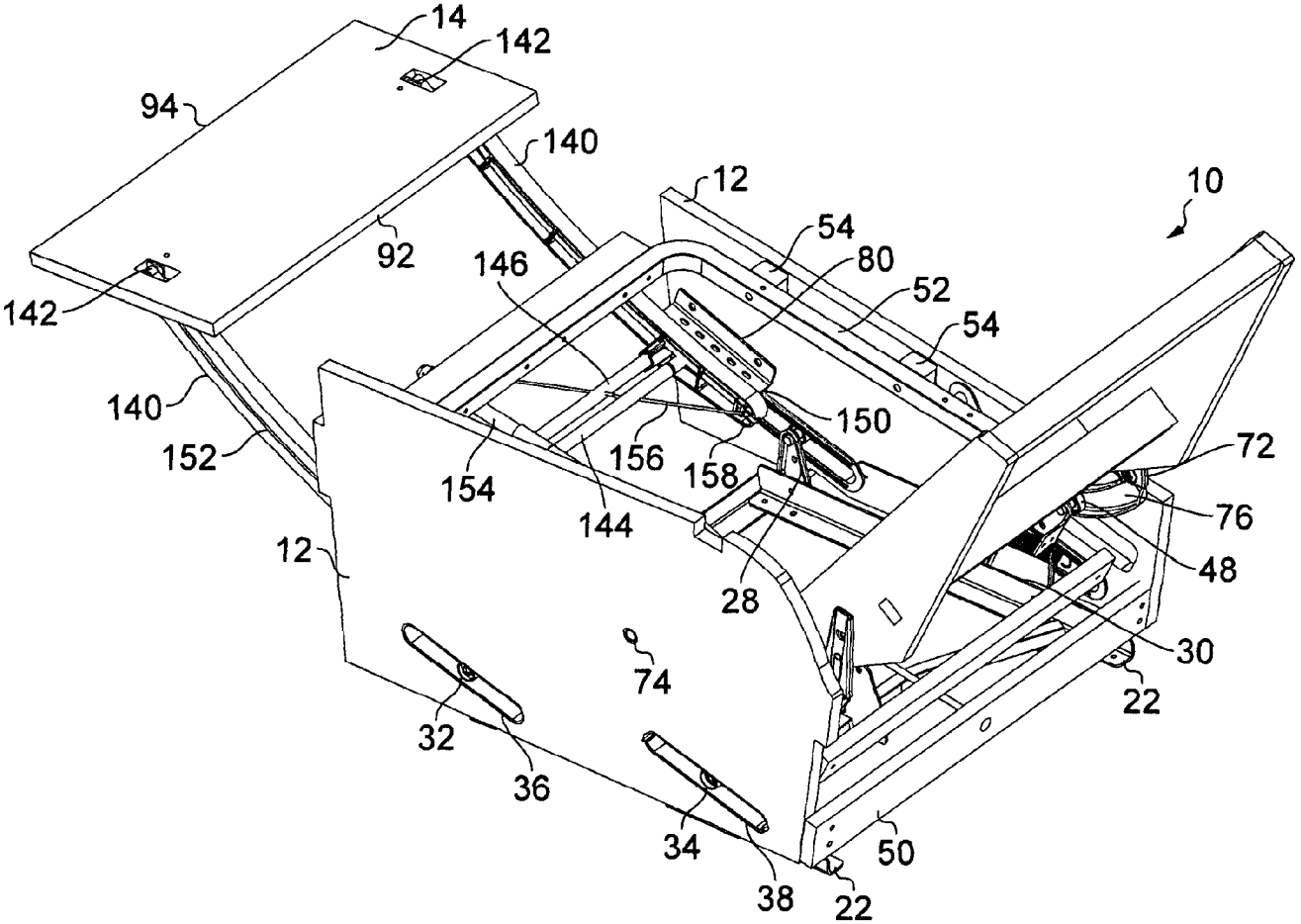
FIG. 18 is a perspective view from the rear of a recliner chair support arrangement and recliner operating mechanism according to a further embodiment of the present invention.
Figure 19:
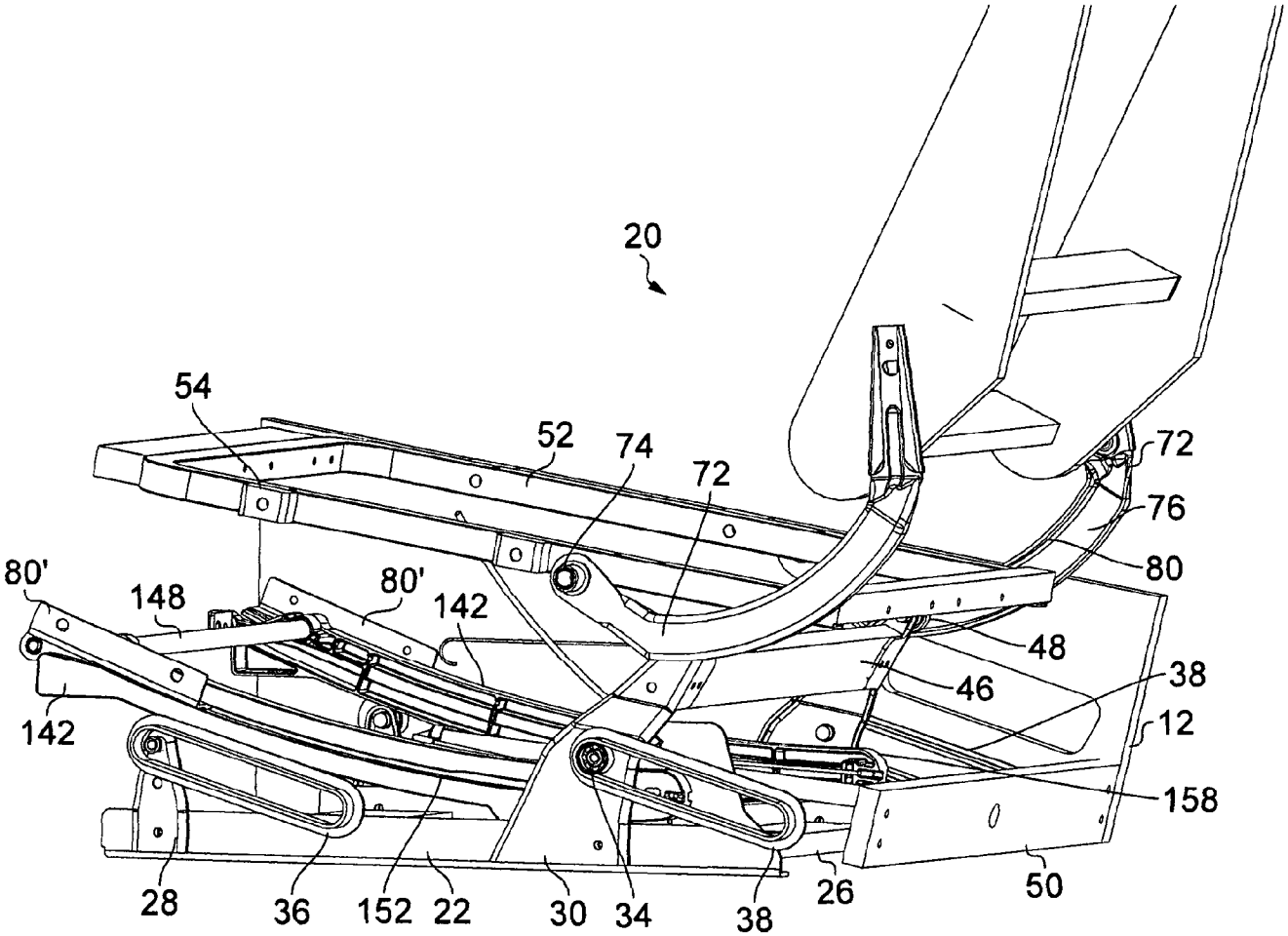
FIG. 19 is a perspective view of the support and recliner arrangement and mechanism shown in FIG. 18 with various components parts omitted from the drawing.

FIG. 18 is a perspective view from the rear and above of a support and operating mechanism 10 according to the third embodiment of the present invention. FIG. 19 is a perspective view from the rear of the support and operating mechanism of FIG. 18 with the left hand side panel and footrest panel omitted for clarity. The recliner part of the support and operating mechanism of FIGS. 18 to 21 is substantially identical to that described above with reference to the embodiment of FIGS. 3 to 13. The footrest part of the support and operating mechanism is different. As can be seen in the drawing of FIG. 18 The footrest board or panel is pivotally connected to a pair of elongate arcuate mounting arms provided on both lateral sides of the chair. The panel 14 is pivotally connected to the arms 140 at a point substantially midway between the top and bottom edges 92, 94 with the pivotal connections between the arms 140 and the panel 14 provided in the plane of the panel 14 in respective apertures 142. In this way the pivot axis of the panel is positioned in the plane of the panel, preferably in the middle of the panel between the front and rear planar surfaces of the panel. This is advantageous in terms of foot rest deployment and retraction since it provides for a counterbalanced footrest that can be readily rotated about its pivot axis by the seated user by the action of applying a slight amount of pressure to the furthermost extended half of the panel, as in the configuration shown in FIG. 18, by movement of the seated user's ankles to create a slight turning moment to cause the panel to rotate and then retract as will be described in more detail below.

The arcuate mounting arms lie parallel with respect to each other on opposing sides of the support and operating mechanism 10 between respective side panels 12. The arms 140 are connected together at various positions along their length by tubular cross-members 144,146 and 148 to provide a rigid frame structure. It is to be understood that this rigid frame structure may be considered the equivalent of the movable ottoman board 78 in the first embodiment of FIGS. 3 to 13. In common with the ottoman board 78 the rigid frame structure is mounted for movement with respect to the side panels 12 on brackets 80' which in this embodiment are provided with a curved flange 150 which engage corresponding curved guide recesses 152 in the respective arms 140 to guide the arms along a curvilinear path between the retracted and deployed position of the footrest.

As can best be seen in the drawing of FIG. 18, a gas strut 154 is provided for biasing the footrest outwards towards its deployed position. The gas strut is anchored at one end (not shown) to part of the intermediate support structure 18 and is connected at its extension end to a cord 156 which is held under tension by the gas strut between two anchorage points 158 at the end of the respective arms 142 furthest from the footrest panel 14. The gas strut 154 and cord 156 may be considered the equivalent of the constant force coil springs 84 in the embodiment of FIGS. 3 to 13. A release catch (not shown) is provided in a similar way to that of the first embodiment of FIGS. 3 to 13 for holding the foot rest in its retracted (vertical) position against the biasing force of the gas strut 154, which catch is released by means of a Bowden cable as previously described and well know in the art.

Figure 20:
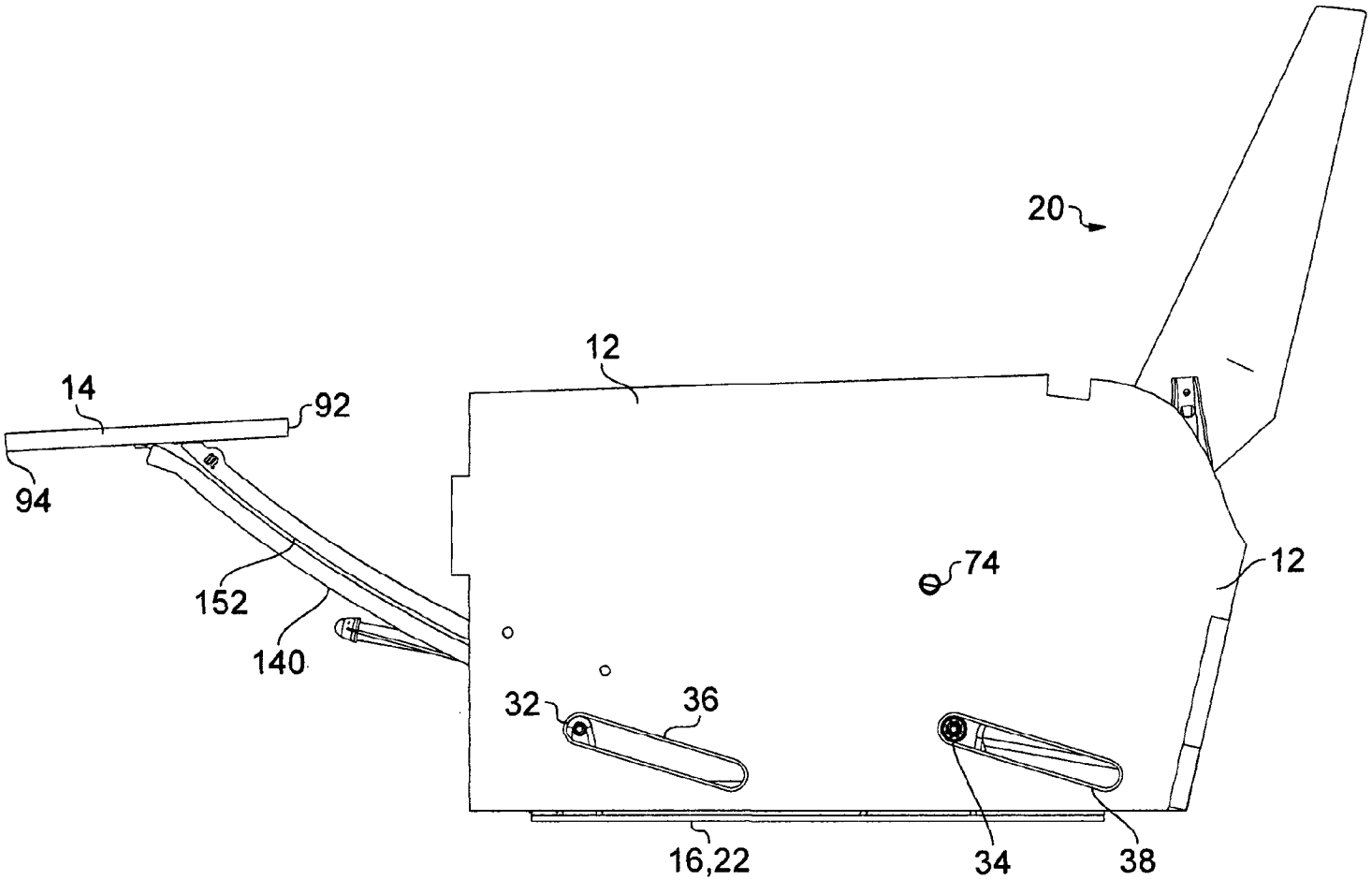
FIG. 20 is a side elevation view of the support and recliner arrangement of FIG. 18 with the backrest upright and footrest deployed.
Figure 21:
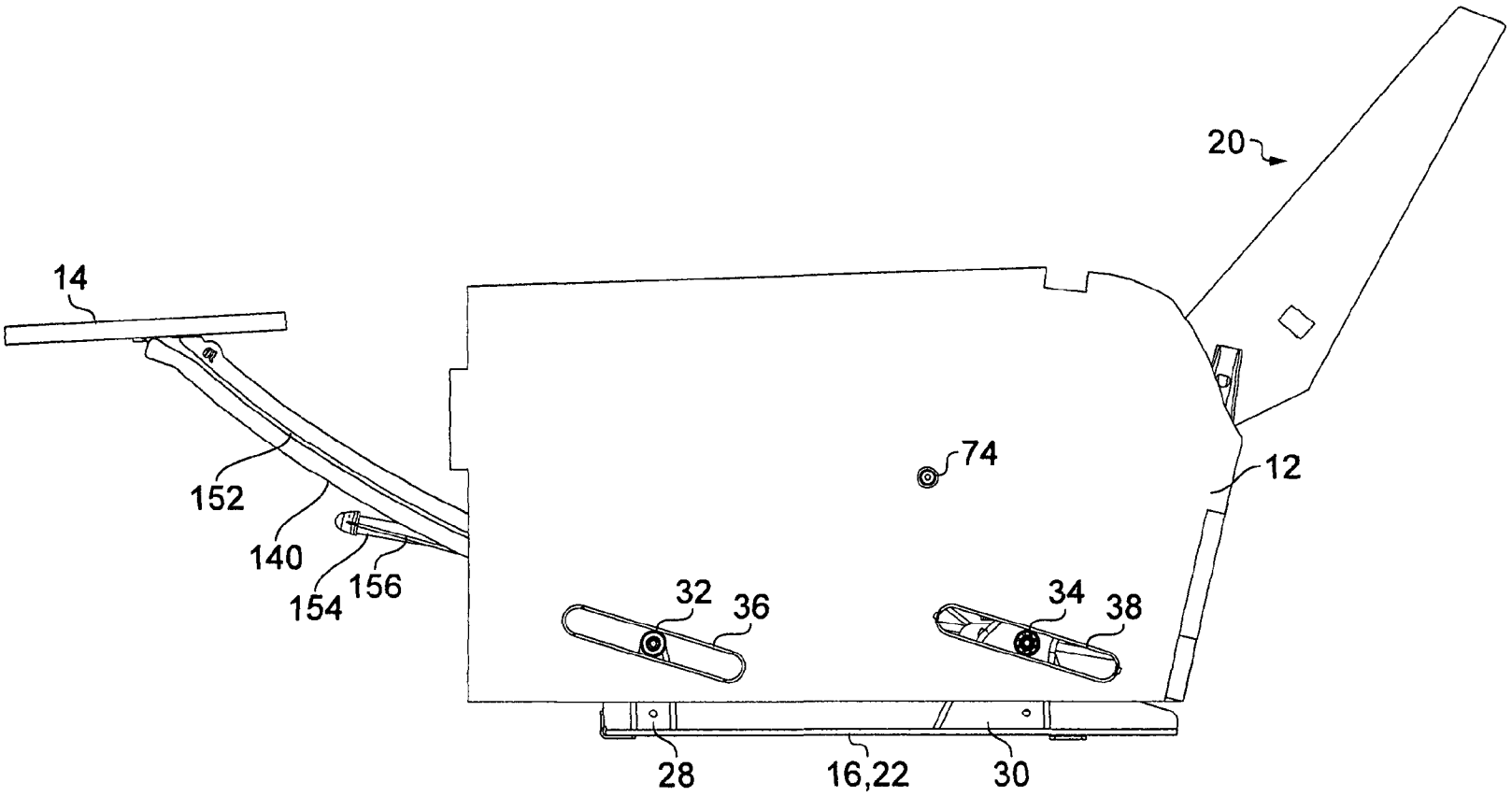
FIG. 21 is a side elevation view similar to FIG. 20 with the backrest moved to a half reclined position.
Figure 22:
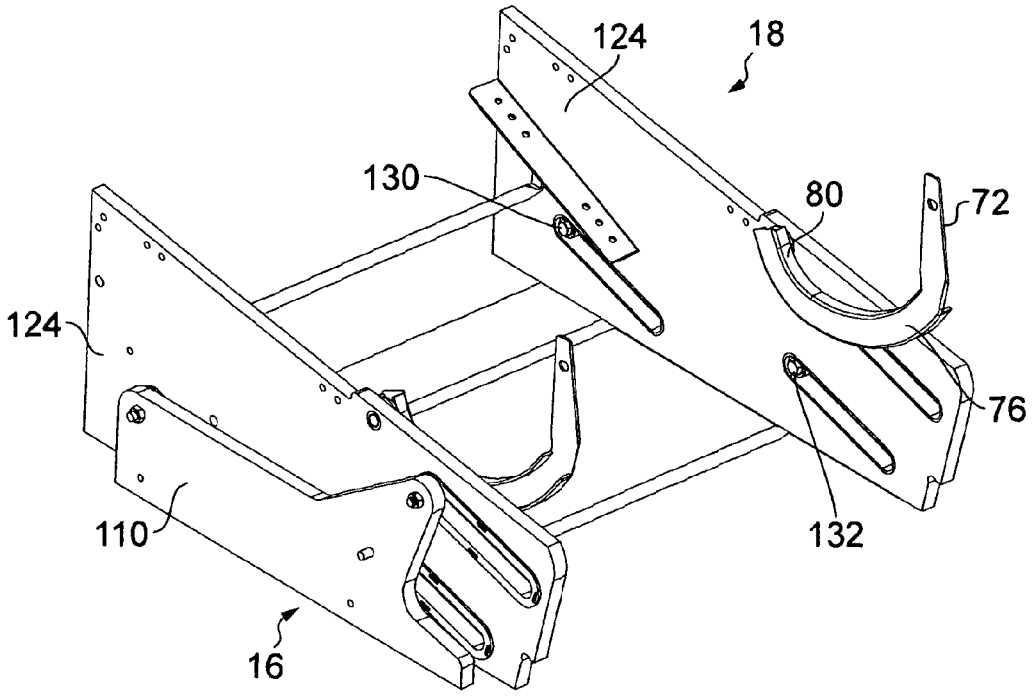
FIG. 22 is a perspective view from above and rear of parts of a recliner chair support arrangement and operating mechanism according to a further embodiment of the present invention.
Figure 23:
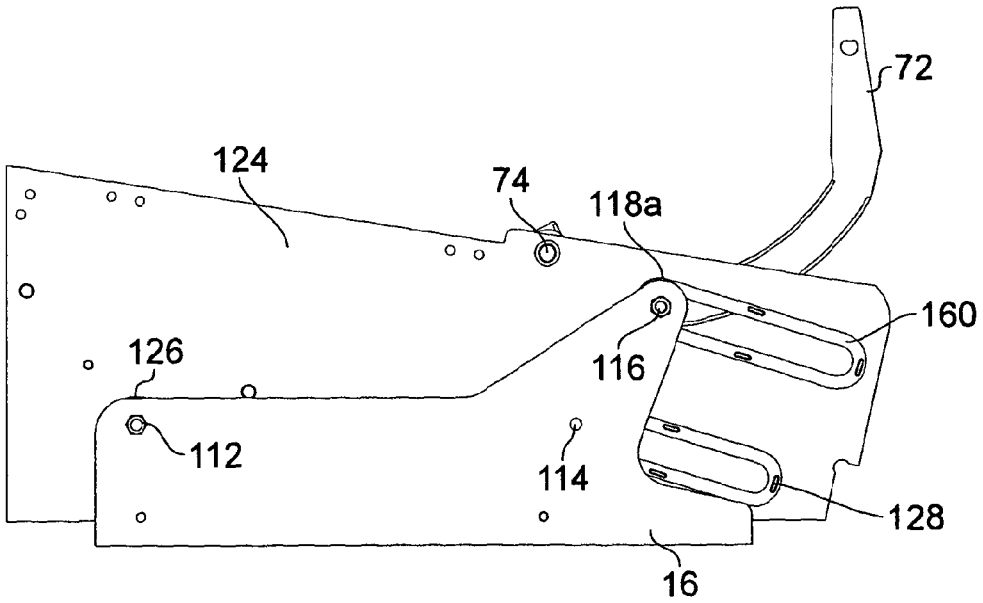
FIG. 23 is a side elevation view of the arrangement of FIG. 22.
Figure 24:
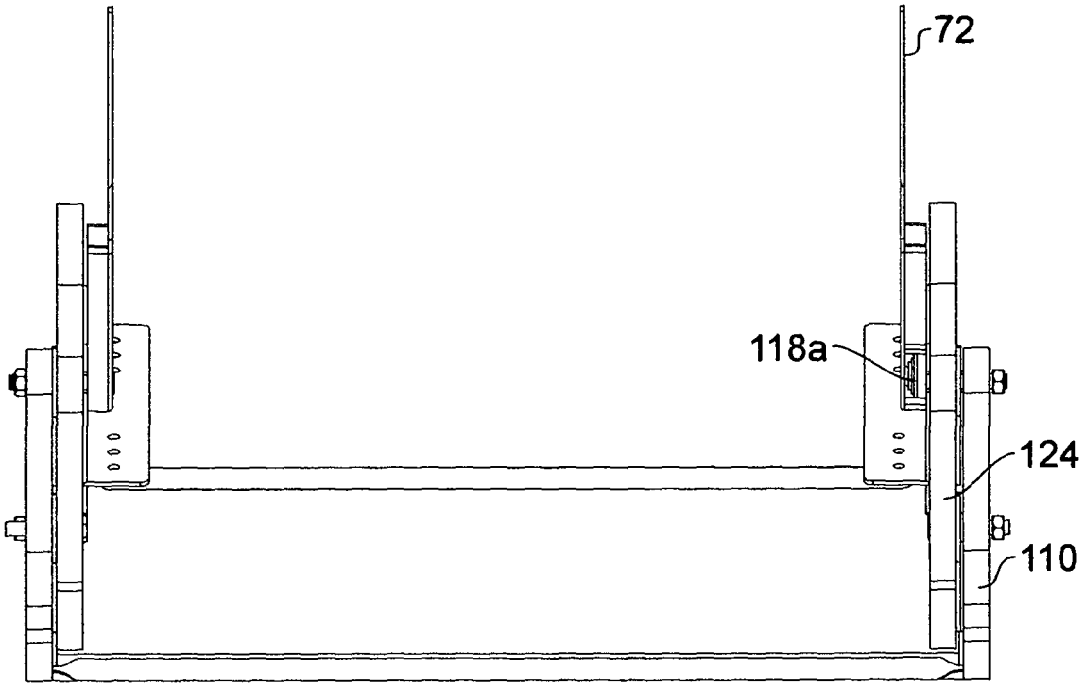
FIG. 24 is a rear elevation view of the arrangement of FIGS. 22 and 23.

Referring now to FIGS. 20 and 21, in the upright (non-reclined) TV position of FIG. 20, the footrest board 14 is deployed outwards and upwards by the footrest operating mechanism previously described. FIG. 21 shows the frame of the chair moved to its half reclined position by rotation of the backrest support 20 about its pivot axis at 74 which causes the intermediate support 18 including the side panels 12 to move upwards and forwards with respect to the base along a trajectory defined by the slots 36, 38. The forward component of this movement provides the so called "zero wall" function. Said first guide means including at least one guide associated with one of the base and intermediate support and at least one follower associated with the other of the base and intermediate support Referring now to FIGS. 22 to 24, which show part of a recliner chair arrangement according to a fourth embodiment of the invention. The general principle of construction and operation of the arrangement shown in FIGS. 22 to 24 is substantially the same as that in the previous embodiments in that there is provided a base support 16 an intermediate support 18 and a back support (not shown), the same reference numerals being used in the drawings of FIGS. 22 to 24 to indicate the same or similar components present in the previous embodiments. It will be understood that the fourth embodiment is substantially a hybrid of the first and second embodiments in that like the second embodiment the L-section chassis legs 22 of the first and third embodiment are replaced by a planar support panel 110 similar to the support panel of the intermediate support in the second embodiment. In the fourth embodiment the panel 110 carries three roller bearings at three positions indicated at 112, 114 and 116 in the drawings. The roller bearing 118 rotatably mounted on the side of the panel at 116 is provided in two parts, that is to say two roller bearing elements are provided on the same shaft or pin so that the two bearing elements are coaxially aligned at 116. One of the bearing elements 118*a* (shown as hidden detail by the hatch lines in the drawing) is equivalent to the bearing 48 in the first and third embodiments and engages the upper lip 80 of a respective guide 76 on a backrest bracket 72, the second bearing element (not shown) engages a third guide slot 160 in the panel 110, the third guide slot and second bearing elements comprise part of the aforementioned first guide means including the slots 126, 128 and bearings 130, 132 with the third slot 160 arranged parallel to the other two slots 126, 128 in the panel. As can be seen in the drawings the backrest support bracket 72 is pivotally mounted to the panel by pin 74 as previously described with reference to the embodiments of FIGS. 3 to 13 and 18 to 22. In the embodiment of FIGS. 22 to 24 the side panel 110 of the intermediate support is positioned inboard of the base support panel 110, but it is to be understood that embodiments are also envisaged where the base support panel is inboard of the intermediate support panel.

A fifth embodiment of the present invention comprises an adjustable bed 210 shown in FIGS. 25 to 36.

Embodiments of the present invention also include adjustable beds.

FIGS. 25 to 36 show schematically an adjustable bed 200 according to a fifth embodiment of the present invention. The bed 200 comprises an adjustable back support section 202, a fixed middle support section 204, an adjustable upper leg support section 206 and lower leg support section 208.

In FIGS. 25 to 27 and FIGS. 31 and 32 the bed 200 is shown in its lowered configuration with the back support section 202, middle support section 204 and leg support sections 206, 208 lowered where the adjacent support sections lie substantially flat above a base support 210. The support sections 202, 204, 206, 208 comprise respective adjacent flat planar panels 212, 214, 216, 218 which support respective adjacent mattress support cushions or pads 220, 222, 224, 226 which combine to provide a mattress support foundation on which a suitable mattress (not shown) is supported to provide a so called "soft edge" adjustable bed. The bed 200 is a double bed but the present embodiment contemplates beds of many different widths including standard single size beds to much larger doubles.

Figure 26:
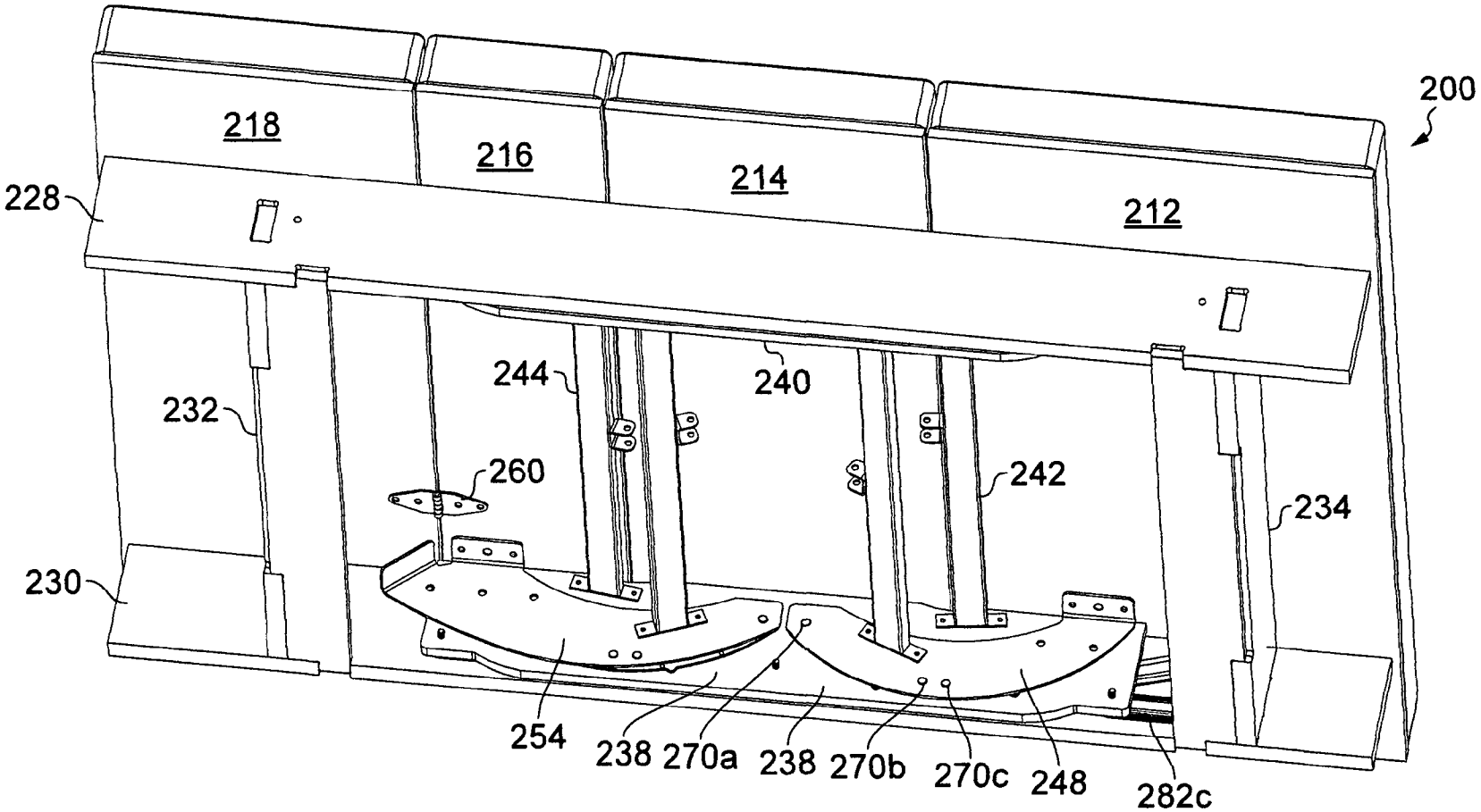
FIG. 26 is a perspective view from below of the underside of the adjustable bed of FIG. 25.

As can best be seen in FIG. 26, the base support 210 comprises a generally rectangular frame constructed by a board type material which may be an engineering plastic, MDF, timber or other fibre type board for example. The base support frame 210 includes a pair of elongate lateral side panels 228, 230 which are joined together near their respective ends by cross member panels 232, 234 to form a rectangular box type structural support frame. The base support frame 210 constitutes the floor standing part of the bed 200 and in this respect the support frame may stand directly on the floor or be provided with castors, feet or the like as is well know in the art.

Figure 27:
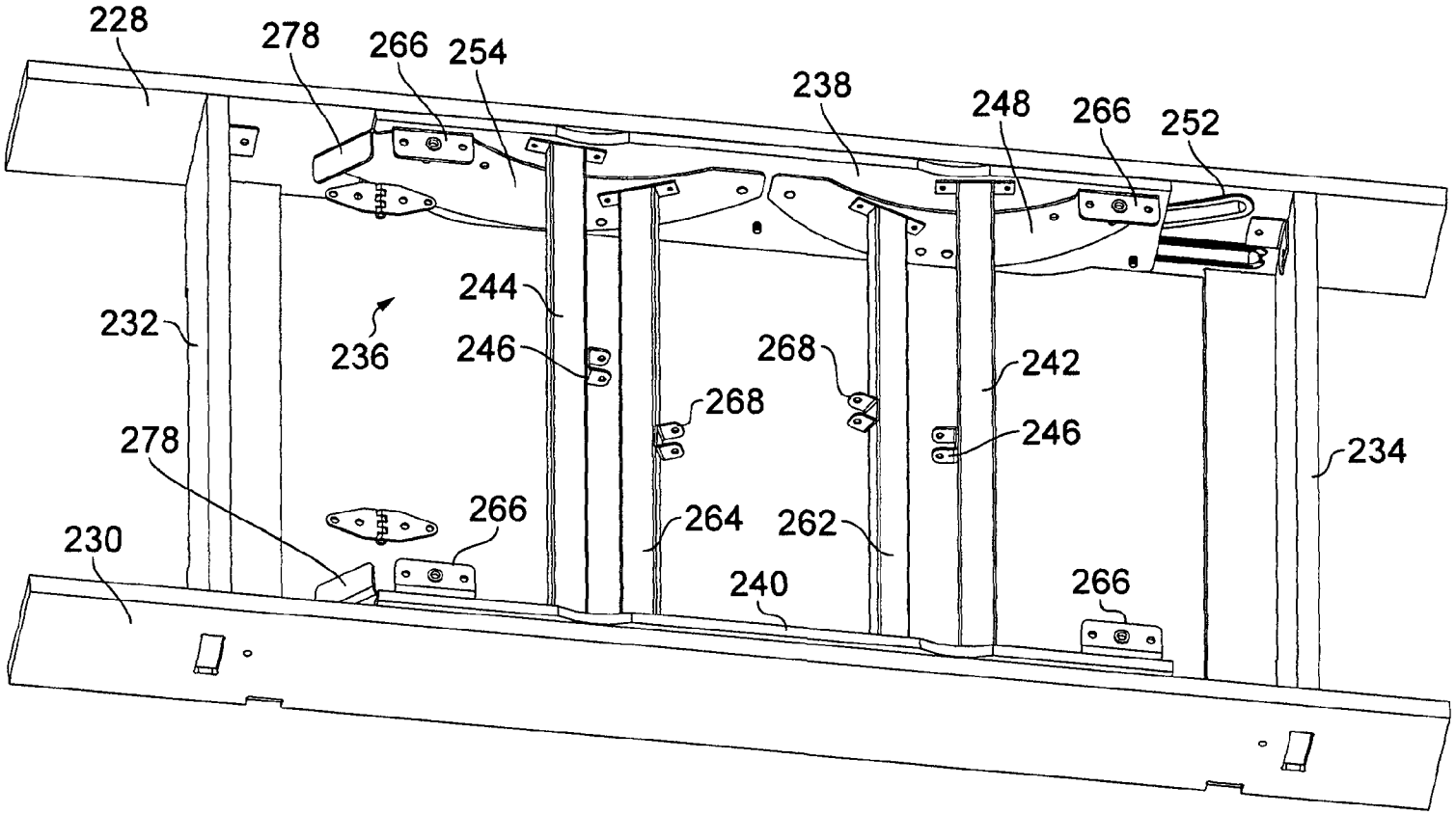
FIG. 27 is a perspective view from above of the adjustable bed of FIG. 25, with various parts omitted for clarity.
Figure 28:
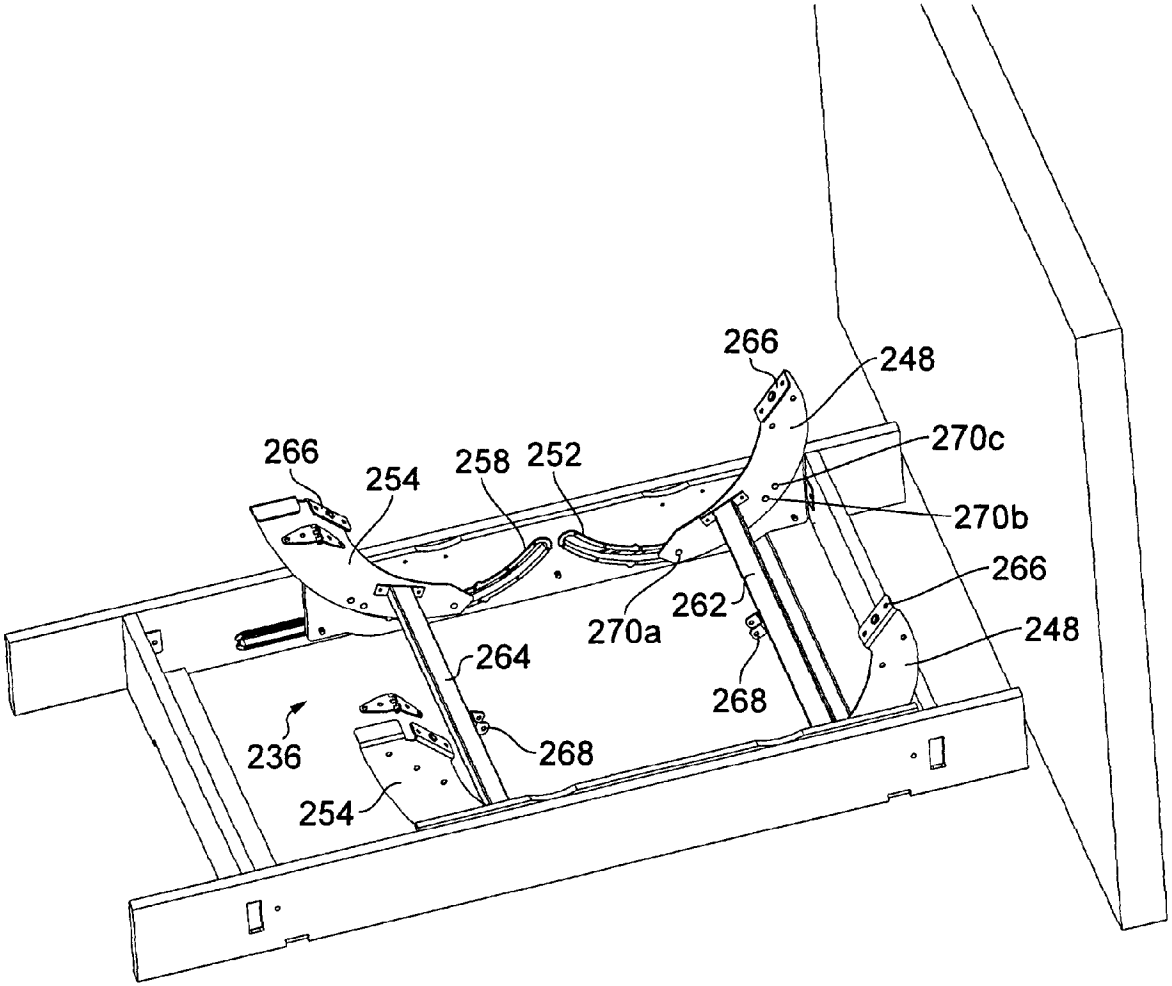
FIG. 28 is a perspective view from above showing the same component parts of the bed of FIG. 25, with the parts positioned in a raised configuration of the bed.

An intermediate support in the form of a movable carriage 236 is mounted within the interior region of the base support frame 210 on the underside of the body support sections 202, 204, 206, 208. The intermediate support 236 can best be seen in the drawings of FIGS. 27 and 28 where the body support panels 212-218 and their associated mattress support cushions 220-226 are omitted from the drawings for clarity. In FIG. 27 the illustrated component parts of the bed are shown positioned with the bed in its normal flat configuration. In FIG. 28 the illustrated parts are shown with the bed positioned in a fully upright configuration. The intermediate support carriage comprises a pair of elongate parallel side panels 238, 240 disposed adjacent the lateral left and right hand side panels 228, 230 of the base support frame. The panels 238, 240 are symmetrically identical such that the mounting arrangement on one side of the bed is the same as the other. The panels are rigidly joined together by a pair of parallel cross members 242, 244 which are spaced apart along the length of the bed. The panels 238, 240 are preferably constructed from a board material such as MDF or an engineering plastic as commonly used in the furniture industry and suitable for CNC machining. The cross-members 242, 244 may be constructed from the same material as the side panels but may also be metal, preferably steel for supporting applied actuator loads to move the various body sections as will be more fully described below. The cross-members 242, 244 are each provided with respective actuator mounting brackets 246 at the mid point along their length.

The back support panel 212 is pivotally mounted to the intermediate support carriage by a pair of load support members 248 attached to and extending from the underside of the support panel 212. The load support members 248 are spaced apart and located at laterally spaced positions on the panel 212 so that they lie substantially adjacent to the respective side panels 238, 240 of the intermediate support on the internal side thereof such that rolling element bearings 250*a*,

250*b*, 250*c* (FIGS. 29, 30 and 31) rotatably mounted on the sides of the load bearing members 248 locate, and are held captive in, respective arcuate slots 252 in the respective panels 238, 240. The load bearing support members 248 constitute a connecting lever pivotally mounting the back rest support 202 with respect to the intermediate support.

The upper leg support panel 216 is similarly pivotally mounted to the intermediate support carriage by a pair of load support members 254 attached to and extending from the underside of the support panel 216. The load support members 254 are spaced apart and located at laterally spaced positions on the panel 216 so that they lie substantially adjacent to the respective side panels 238, 240 of the intermediate support on the internal side thereof such that rolling element bearings 256*a*, 256*b*, 256*c* (FIGS. 29 and 30) rotatably mounted on the sides of the load bearing members 254 locate, and are held captive in, respective arcuate slots 258 in the respective panels 238, 240.

Figure 25:
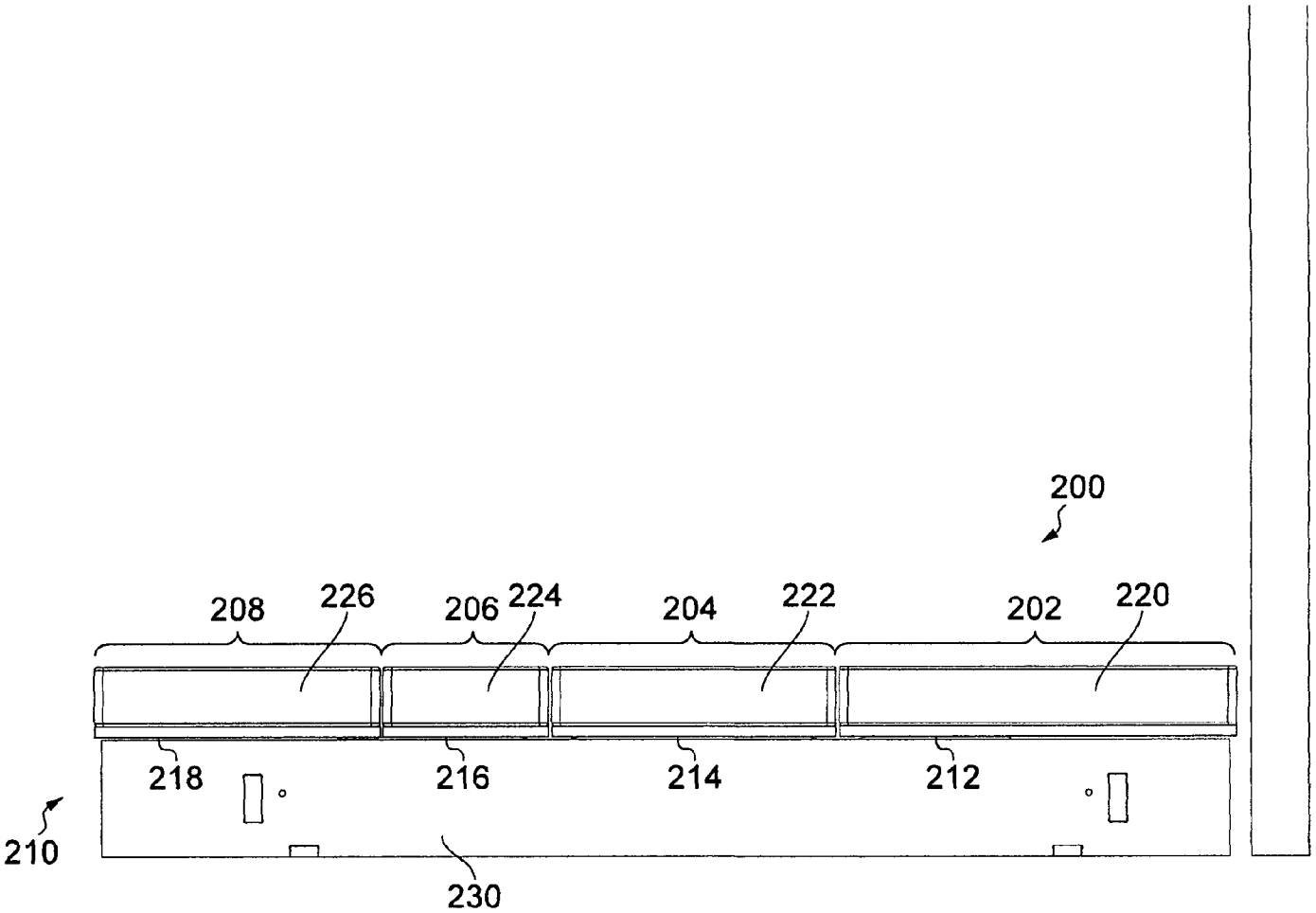
FIG. 25 is a side elevation view of an adjustable bed according to another embodiment of the present invention.

The mid section panel 214 is fixed with respect to the intermediate support carriage immediately between the back and upper leg support panels 212, 216 in the lowered configuration of the bed as shown in FIG. 25. The lower leg support panel 218 is pivotally connected to the upper leg support panel 216 along their respective adjoining edges by hinges 260.

The load bearing members 248 and 254 are substantially planar having a crescent shape and are designed such that they lie substantially flush with a small clearance of a few millimeters or so) with the respective side panels 238, 240 of the intermediate support, within the envelope of the base support carriage in the lowered configuration of the bed as shown in FIGS. 26 and 27, with the panels 212-218 lying substantially flat on or just above the top edge of the base support frame 210. The load bearing support members 248, 254 are each provided with inwardly projecting planar elements 266 which extend perpendicular to the plane of the support members to provide mounting members for engagement with and fixing to the underside of the respective panels 212 and 216.

The load bearing support members 248 are rigidly connected together by means of a cross-member 262, and similarly the load bearing support members 254 are connected together by a cross-member 264. The cross-members 262, 264 are each provided with actuator mounting brackets 268 at a mid point along their length, each for connection to one end of a respective linear actuator (not shown).

Figure 29:
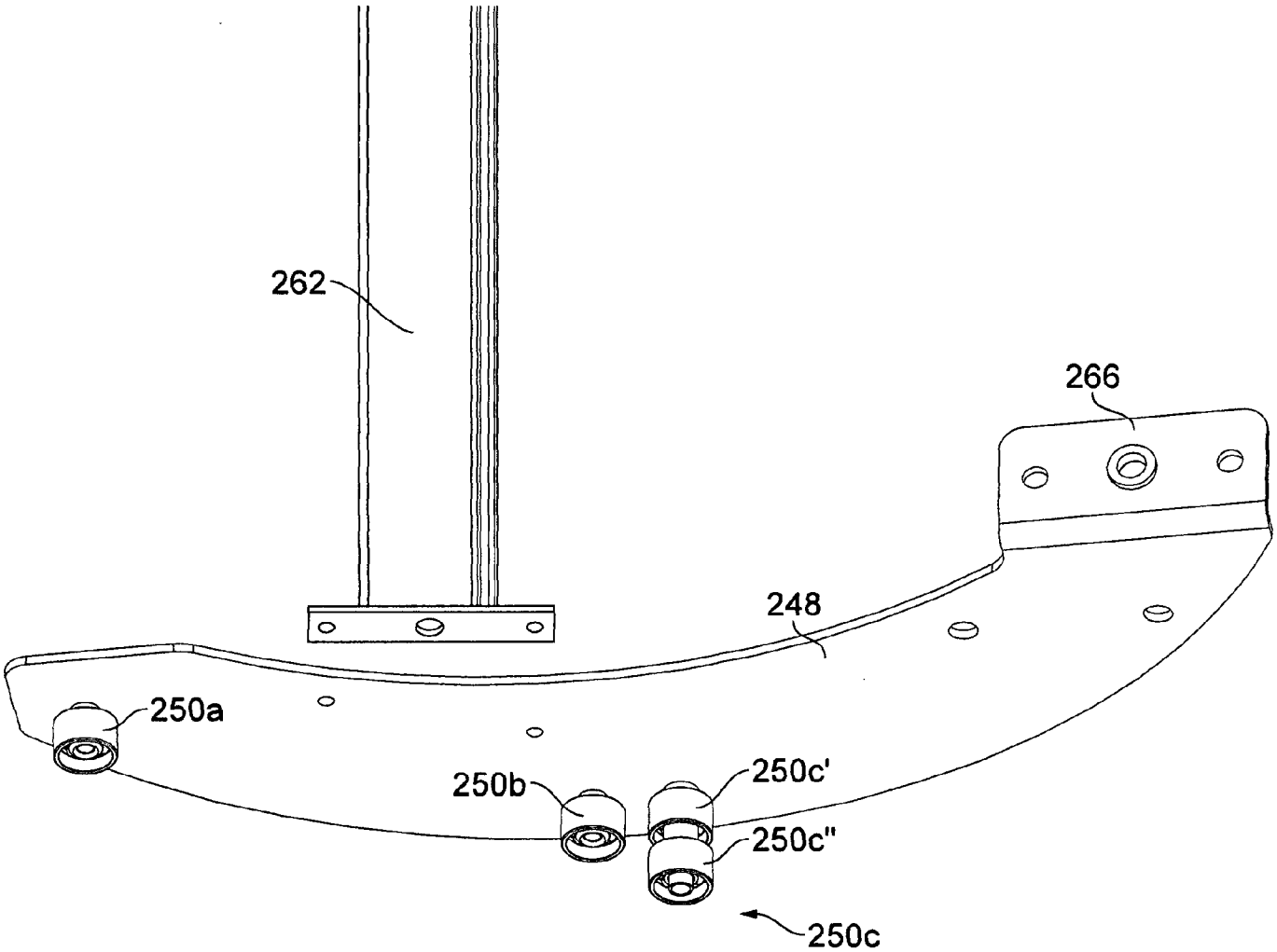
FIG. 29 is a perspective view of component parts of the bed of FIG. 25.
Figure 30:
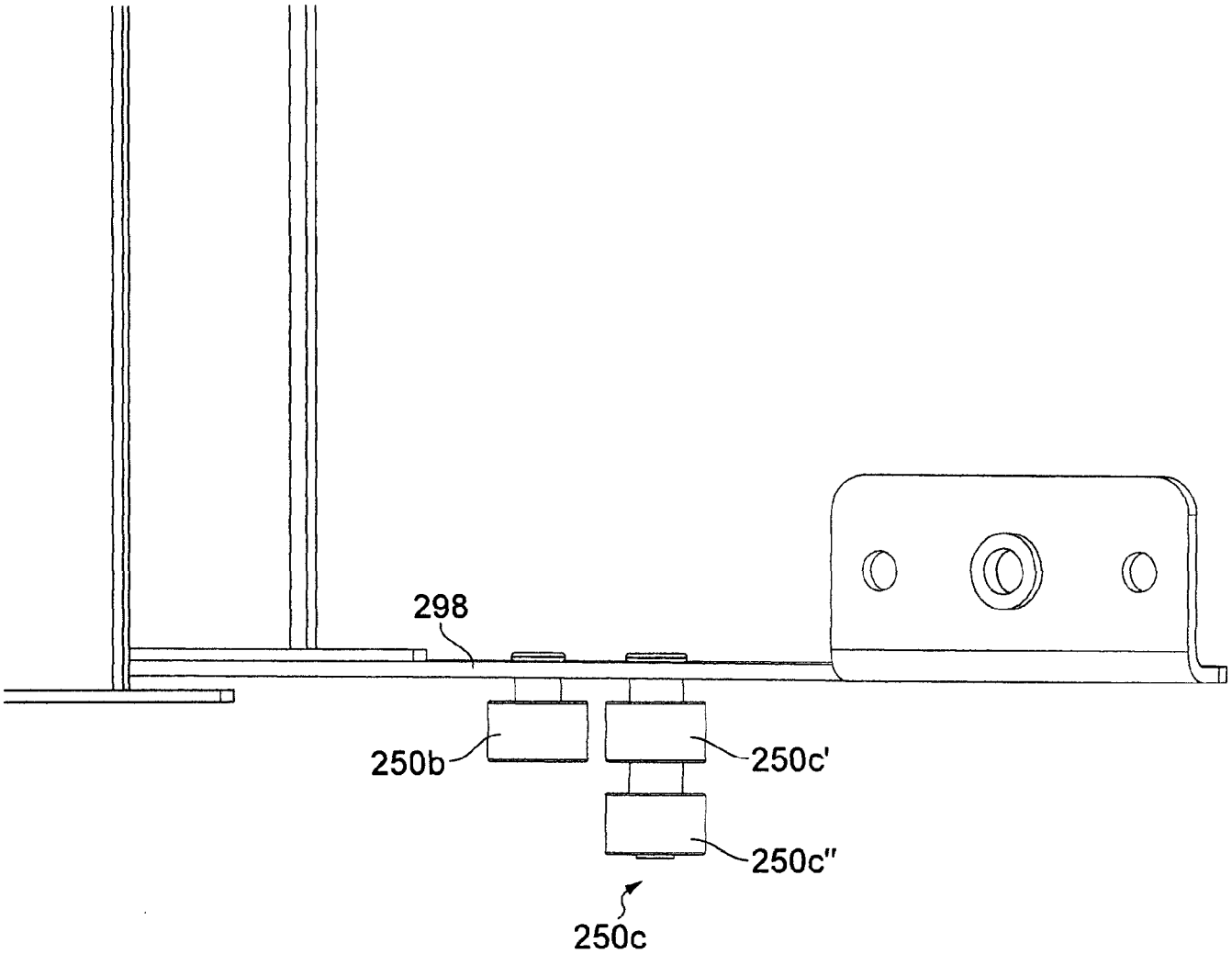
FIG. 30 is a plan view of the parts shown in FIG. 29.

As can best be seen in the drawing of FIG. 29 each load bearing member 248 is provided with rolling element bearings 250*a*, 250*b*, 250*c* located on that side of the support member facing the adjacent side panel of the intermediate support carriage. The bearings 250*a* and 250*b* are of similar construction and comprise a single rolling element bearing mounted on an upstanding pin extending from the surface of the load bearing member. The third bearing 250*c* is slightly different in that it comprises a pair of bearing elements 250*c*' and 250*c*" aligned coaxially on a longer pin. This arrangement is shown further in the plan view of bearing 250*c* in FIG. 30 where the outer most bearing element 250*c*" is located approximately twice the distance from the load bearing support member than the first bearing element 250*c*'. The bearings 250*a*, 250*b* and 250*c* are located at positions indicated 270*a*, 270*b* and 270*c* on the other side of the support member 248 shown in the drawings of FIGS. 26-28.

The bearing arrangement on the load bearing support members 254 is similar to that described above in relation to support members 248, except that is that all three bearings 256*a*, 256*b* and 256*c* are of the single element type as 250*a* and 250*b*, and positioned respectively at positions 272*a*, 272*b* and 272*c*, as indicated on the reverse side of the support members in FIGS. 26-28.

On both sides of the bed bearings 256*a*, 256*b* and 256*c* are located in slot 258 so that the movement of the support members is constrained by the movement of the bearings in those slots 258. This provides the panel 216 and hence the upper leg support section 206 with pivotal movement, with respect to the intermediate support, with the pivot axis defined by the centre of curvature of the slots 258 and with the extent of travel being determined by the length of the slot and the separation of the bearing elements 256*a* and 256*c* in the slot. The range of pivotal movement of the support members 254 is defined by the ends of the slot 258 and the separation of the respective bearings 256*a* and 256*c* by abutment of a respective one of the bearings with a respective end of the slot. The bearings 256*a* and 256*c* may be spaced apart by a maximum distance corresponding to approximately half the length of the curved slot 258.

Similarly bearings 250*a*, 250*b* and 250*c*' are located in slots 252 so that the movement of the support members is constrained by the movement of the bearings in the slots 252. This provides the panel 212 and hence the back support section 202 with pivotal movement, with respect to the intermediate support, with the pivot axis defined by the centre of curvature of the slots 252 and with the extent of travel being determined by the length of the slot and the separation of the bearing elements 250*a* and 250*c*' in the slot. The range of pivotal movement of the support member 248 is defined by the ends of the slot 252 and the separation of the respective bearings 250*a* and 250*c*' by abutment of a respective one of the bearings with a respective end of the slot. The bearings 250*a* and 250*c*' may be spaced apart by a maximum distance corresponding to approximately half the length of the curved slot 252

Figure 31:
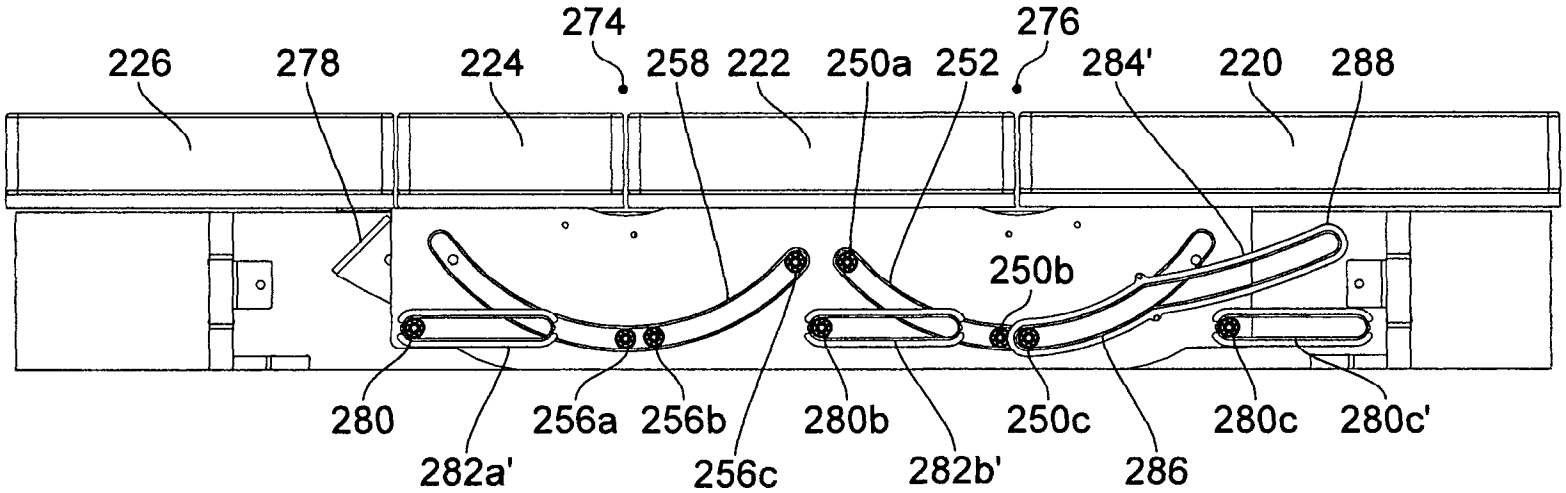
FIG. 31 is a side elevation similar to that of FIG. 25 with an outer panel of the bed omitted to show internal detail.

The position of the slots 252 and 258 can best be seen in the drawing of FIG. 31 where the side panel 228 has been omitted for clarity for the purpose of illustrating the adjustment arrangement of the bed in greater detail. Although only one of the panels 228 of the intermediate support is shown in the side elevation drawing of FIG. 31 it is to be understood that the panels 228, 230 are substantially identical to one another, each having a pair of curved guide slots 252, 258 for accommodating support bearings 250*a*-*c*' and 256*a*-*c* as previously described. The first guide slot 250 is provided in the rearward half of the panel 228 and the second slot 258 in the forward half of the panel. The centre of curvature 274 of the first slot 258 is positioned at the adjoining edges of the adjacent mattress support cushions 222, 224 so that in use adjustment of the bed between its various positions does not cause compression of the mattress located on top of the support cushions in the region of the adjoining edges. Likewise The centre of curvature 276 of the second slot 252 is positioned at the adjoining edges of the adjacent mattress support cushions 220, 222 so that in use adjustment of the bed between its various positions does not cause compression of the cushions or the mattress located on top of the support cushions in the region of these adjoining edges.

Figure 32:
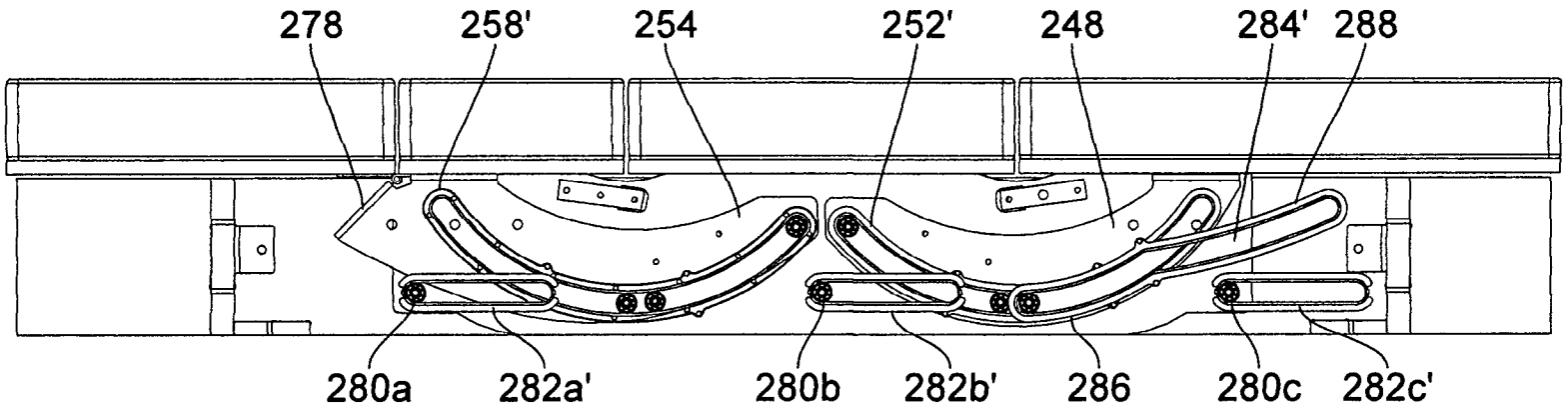
FIG. 32 is a similar view to that of FIG. 31 with a further panel omitted.
Figure 33:
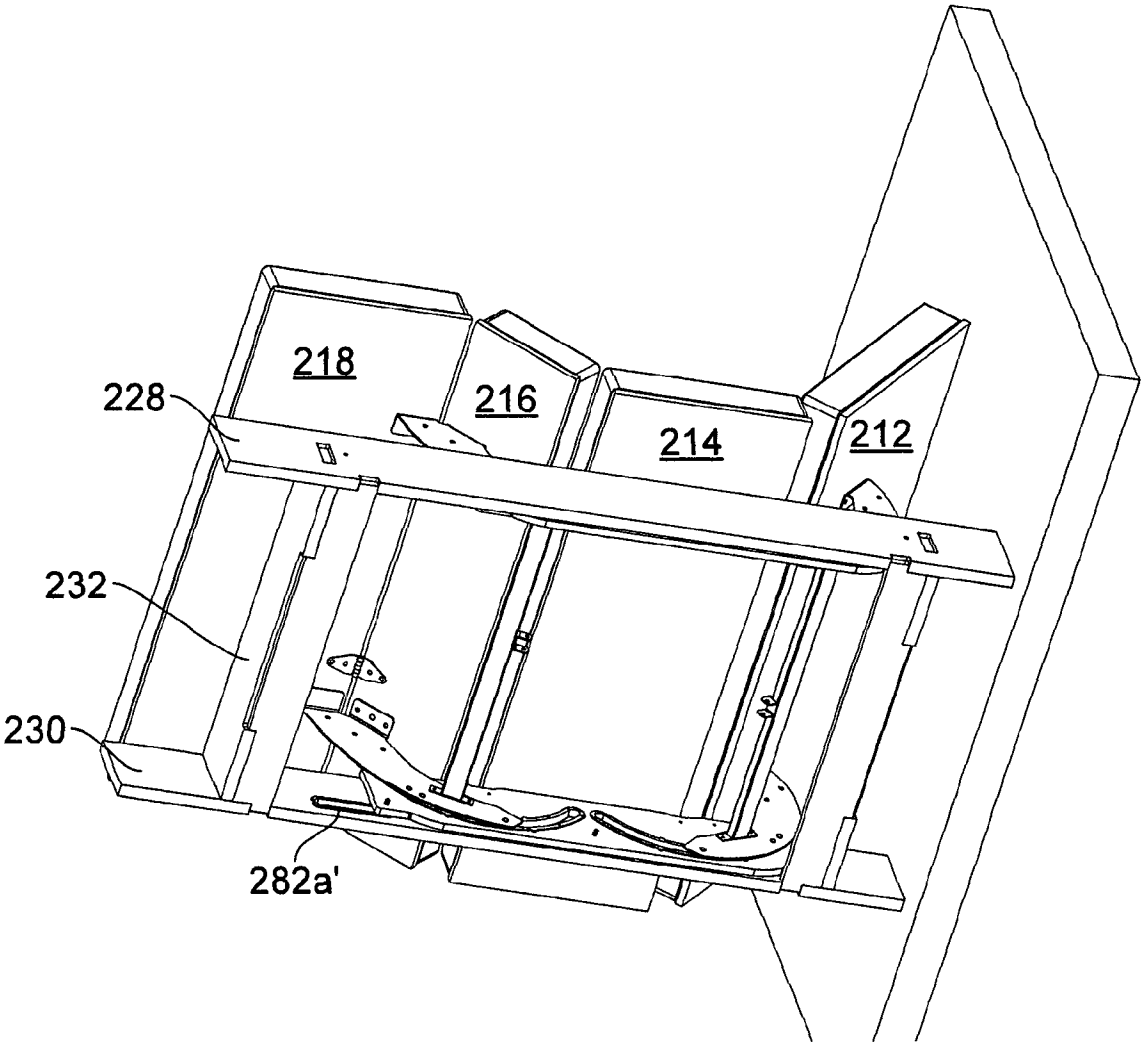
FIG. 33 is a perspective view from below showing the underside of the bed when in a raised position.

The position of the bearing elements 250*a*-*c* and 256*a*-*c* is illustrated in the drawing of FIG. 31 when the bed is in its lowered configuration, with the bearing 256*c* at the rear end of the front slot 258 and the bearing 250*a* positioned at the front end of the rear slot 250. The The position of the bearing elements 250*a*-*c* and 256*a*-*c* is also illustrated in the drawing of FIG. 32 in which the side panel 240 is also removed to show further detail. In this drawing the position of the front and rear slots is indicated by slot inserts 252' and 258' which are illustrated in their in-situ position as if the side panel 240 were present. The inserts 252' and 256' provide a hardwearing bearing surface for the bearing elements 250*a-c*' and 256*a-c* and fit in appropriately sized slots in the respective side panels of the intermediate support carriage and function in a similar way to the slot inserts 32, 38 in previous embodiments. In the drawing of FIG. 32 the relative position of the slots 252 and 258 and the load bearing support members 248, 254 can be seen for the bed in its lowered configuration. The side elevation of FIG. 32 also more clearly illustrates the profile of the load bearing support members 248 and 254, including the angled abutment face 278 at the forward end of the load bearing support members 254, the purpose of which will be described in detail below.

The drawings of FIGS. 31 and 32 also illustrate the manner in which the intermediate support carriage is movably mounted with respect to the base support 210. Each side panel 238, 240 is provided with three rolling element bearings 280*a-c*, positioned at spaced apart locations along the length of the respective panels, mounted on bearing pins upstanding from the surface of the respective panel and projecting towards the adjacent outer panel 228, 230 of the base support in which bearing engagement slots 282*a-c* are provided for receiving respective slot inserts 282*a*'-c. The inserts 282*a*'-c' are shown in their respective in-situ positions in the drawings of FIGS. 31 and 32 although the side panel 240 in which they are mounted has been omitted for the purpose of illustration. The inserts 282*a*'-c' are located in blind slots provided on the inward facing surface of the respective side panels 228, 230. Part of the rear slot insert 282*c*' can be seen in the drawing of FIG. 26 and part of the forward slot insert 282*a*' in the drawing of FIG. 33.

The slots 282*a-c* and corresponding inserts 282*a*'-c' are linear and aligned along the length of the panels 228, 230 to guide the intermediate support carriage in a non-inclined linear parallel direction with respect to the base support during adjustment of the bed between its various positions. The slots and inserts are substantially identical and generally equally spaced along the mid part of the bed. The slots 280*a-c* are blind in that they do not create apertures in the side of the panels 228, 230, but are deep enough to accommodate the respective inserts and rolling element bearings 280*a-c* fixed to the intermediate support carriage. This arrangement constitutes the aforementioned first guide means in this embodiment of the invention.

A fourth slot 284 and insert 284' combination is provided towards the rear of the panels 228, 230 which accommodates the bearing element 250*c*" mounted on the rear load bearing support member 248. This arrangement constitutes the aforementioned second guide means in this embodiment. The fourth slot 284 is curvilinear having first and second curved sections 286, 288. The first section 286 has a curvature that matches that of the slot 252 and is coincident with the rear part of that slot when the bed occupies a position between the fully lowered position and the half raised position of FIG. 34. In this range of relative movement the bearing 250*c*" moves freely in the first section 286 as the back support is raised to the half raised position of FIG. 34, then the curvature and direction of the slot changes abruptly. The second section 288 has a different centre of curvature to the first section and rises more gently along the length of the panel 228, 230 than the first section. This change in curvature generates a reaction force between the bearing element 250*c*" and the second section 288 of the slot, which forces the intermediate support carriage forward relative to the base support along guides 280*a-c* as a turning moment is applied (by one of the actuators or otherwise) n to the back support section of the bed. As the back support section is raised beyond the intermediate position of FIG. 34 the bearing 250*c*" is forced to move along the second section of the slot and the resistance that is generated by the reaction of the bearing element with the upper surface of the slot 288 drives the intermediate section forward with respect to the base support. This resultant motion is similar to the relative motion of the support and intermediate support sections of the chair arrangements of the previous embodiments where the back rest is moved. In the present embodiment similar coordinated movement occurs when the back support section of the bed is moved when it is raised to provide a backrest in the upright configuration of the bed. Thus, the bed described in this embodiment also functions as a zero wall item of furniture. This is particularly advantageous in the context of adjustable beds as it enables the user to retain access to beside furniture etc, as the relative position of the user relative to that furniture does not change when the back rest is raised or lowered, as the movement is compensated by the linear forward or backward movement of the intermediate support carriage on which the body support sections are mounted.

Figure 34:
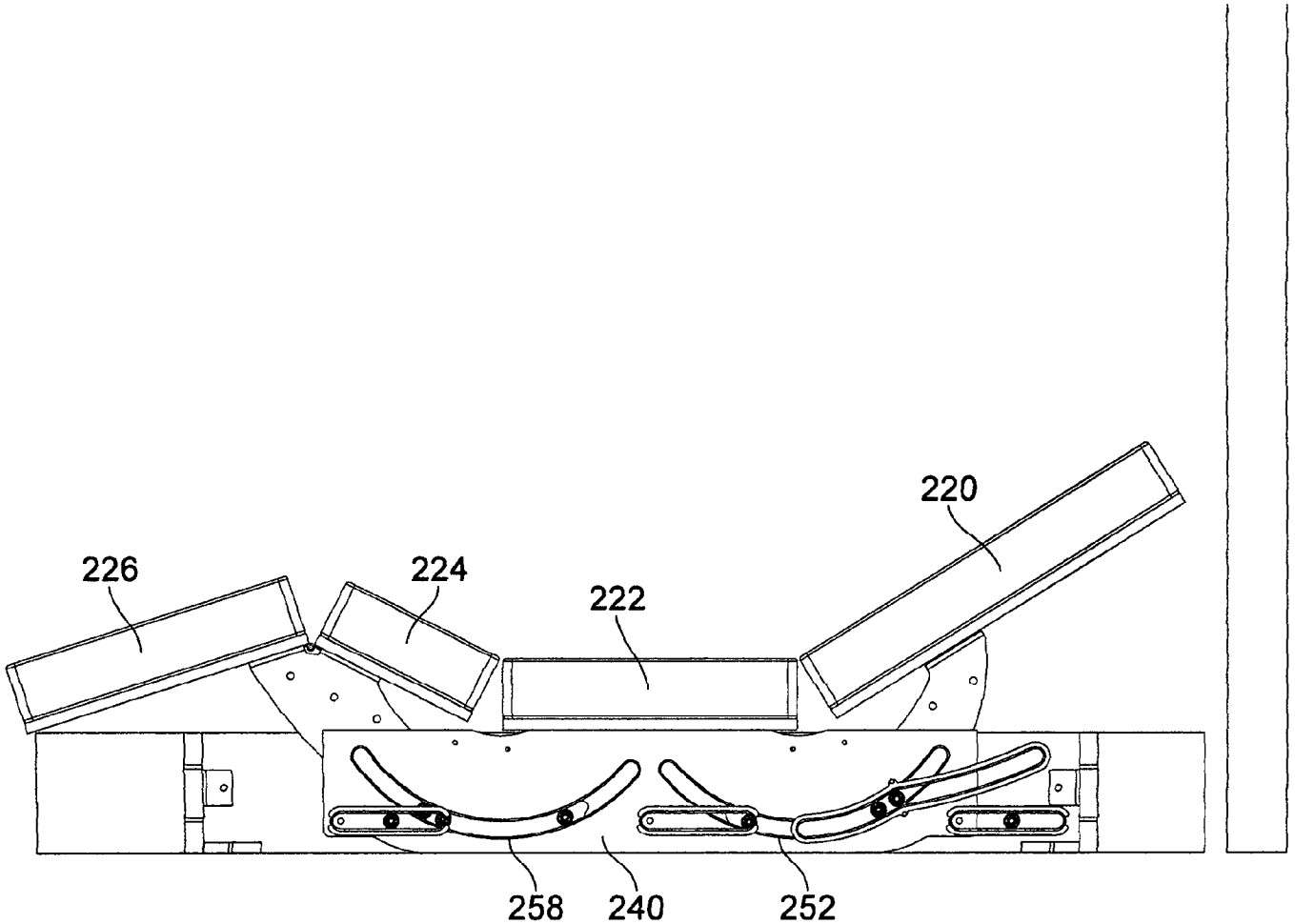
FIG. 34 is a side elevation view similar to that of FIG. 32 with the bed in a part raised position.
Figure 35:
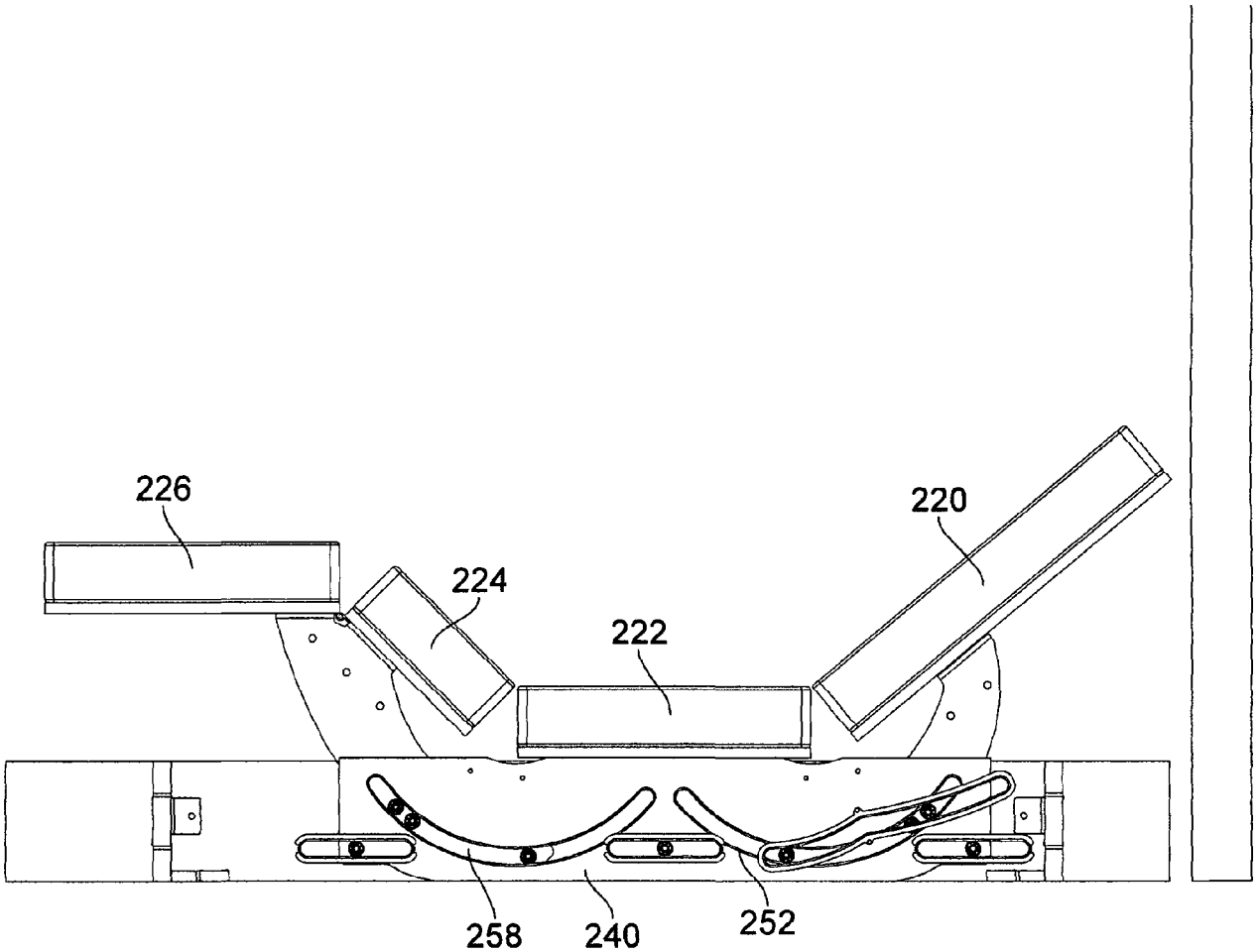
FIG. 35 is a side elevation view similar to that of FIG. 34 with the bed raised further.
Figure 36:
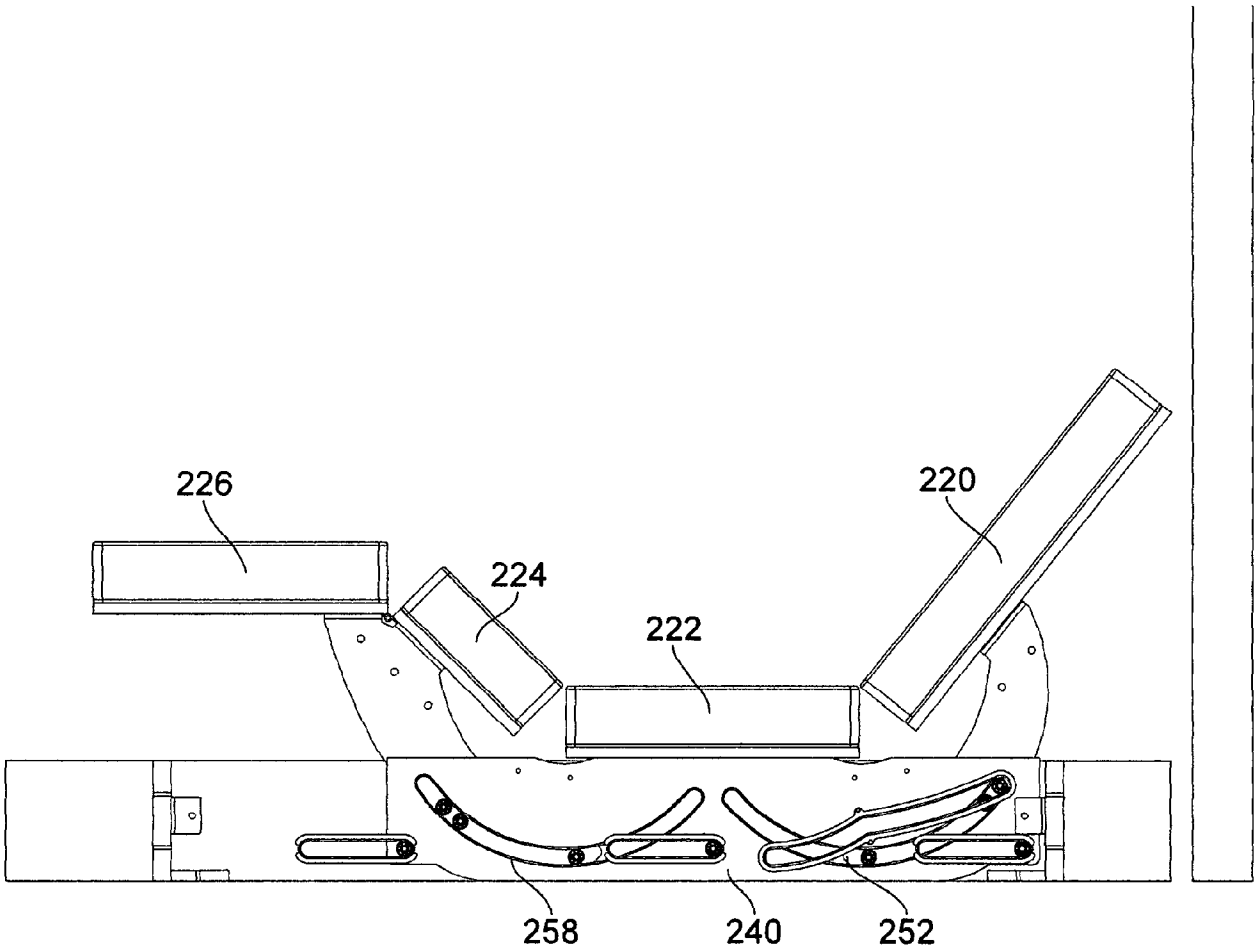
FIG. 36 is a side elevation view similar to FIG. 35 with the bed in it fully raised position.

The relative positions of the various parts of the bed as the configuration of the bed is adjusted from the fully lowered configuration to the fully raised configuration can be seen by following the sequence of drawings of FIG. 32 (fully lowered), FIG. 34 (half raised), FIG. 35 (intermediate between half raised and fully raised) though to FIG. 36 (fully raised). Each drawing presents the same part side view of the bed construction as FIG. 32 and illustrates the relative positions of the bearings in the respective slots as the bed is moved from one configuration to another.

In the illustrated embodiment movement of the bed through the various positions shown is effected by means of two linear electrical actuators of the type commonly used in adjustable furniture arrangements, including a first actuator (not shown) connected between bracket 246 on cross-member 244 and bracket 268 on cross-member 262 for moving the back support section 202, and a second linear actuator (not shown) connected between bracket 246 on cross-member 242 and bracket 268 on cross-member 264 for moving the leg support sections 206. It will be understood by those skilled in the art that the relative position of the linear actuator jacks on the underside of the bed 200 is particularly advantageous, first because the force vector applied by the actuators actually follows the movement of the load bearing support panels as they move, since both ends of the actuator are pivotally connected to the respective aforementioned brackets, and second because the force vector is always offset, by a significant distance, to the respective pivot axis, 274, 276 about which the turning moment generated by the actuator is applied, thus providing the powered arrangement with considerable mechanical advantage.

As can best be seen by comparison of the drawings of FIGS. 32 and 34 the angled abutment surface 278 at the end of each load bearing support member 254 serves to limit the extent of pivotal movement at the hinge connection 260 between the panels 216 and 218. When the support members begin to rotate about their pivot axis at 274 both sections 208 and 206 begin to lift but hinge apart until the position of FIG. 34 is reached when the abutment surface 278 engages the underside of the panel 218. This provides a useful "knee break" function where the users' lower legs are not raised until a comfortable relative position of the upper and lower part of the limbs is first achieved.

The invention claimed is:

1. An article of adjustable furniture comprising:

a base;

an intermediate support; and a back support, the intermediate support being guided for movement relative to the base by a first guide means, the back support being guided for movement relative to both the base and intermediate support by a second guide means, said second guide means including at least one guide associated with one of the base support and the back support and at least one follower associated with the other of the base support and the back support, the at least one guide of the second guide means being shaped as an arcuate curve having no inflection point;

whereby the back support is mounted for pivotal movement with respect to the intermediate support and the first and second guide means are arranged such that, in use, pivoting of the back support relative to the intermediate support causes the intermediate support to move with respect to the base.

2. An article of furniture as claimed in claim 1 wherein said first and second guide means are arranged to provide coordinated pivotal movement of the back support relative to the base and intermediate support and linear movement of the intermediate support with respect to the base.

3. An article of furniture as claimed in claim 1 wherein the back support provides at least part of a lever arrangement, pivotal movement of which also moves the intermediate member with respect to the base.

4. An article of furniture as claimed in claim 3 wherein the second guide means provides a fulcrum about which said lever arrangement acts to move the intermediate member with respect to the base.

5. An article of furniture as claimed in claim 1 wherein the intermediate support is arranged to move in a linear motion with respect to the base.

6. An article of furniture as claimed in claim 1 wherein the back support is pivotally connected to the intermediate support by at least one connecting lever pivotally connected to the intermediate support.

7. An article of furniture as claimed in claim 6 wherein said connecting lever includes the guide of the second guide means and accommodates said follower, or said connecting lever includes the follower of the second guide means and the base support includes the guide.

8. An article of furniture as claimed in claim 6 wherein the second guide means provides a fulcrum point for the connecting lever.

9. An article of furniture as claimed in claim 8 wherein the fulcrum is fixed with respect to the base.

10. An article of furniture as claimed in claim 1 wherein the guide comprises a slot, groove, track in which said follower is located.

11. An article of furniture as claimed in claim 1 wherein the follower comprises one of a roller and a bearing.

12. An article of furniture as claimed in claim 1 wherein the base comprises a chassis on which the intermediate support is movably mounted.

13. An article of furniture as claimed in claim 1 further comprising a seat support or lower body support fixed with respect to the intermediate support.

14. An article of furniture as claimed in claim 1 wherein the first guide means includes at least one guide associated with one of the base and intermediate support and at least one follower associated with the other of the base and intermediate support.

15. An article of furniture as claimed in claim 14 wherein the guide of the first guide means is associated with the intermediate support and the follower is associated with the base, or vice versa.

16. An article of furniture as claimed in claim 1 wherein the guide of the second guide means is associated with the back support and the follower is associated with the base, or vice versa.

17. An article of furniture as claimed in claim 1 wherein the intermediate support includes a pair of lateral side panels, and wherein the side panels include a guide of the first guide means.

18. An article of furniture as claimed in claim 17 wherein the guides are provided as respective slots in the side panels.

19. An article of furniture as claimed in claim 18 wherein each panel includes a pair of said slots which are inclined to guide the intermediate support upwards and forwards with respect to the base when the back support is pivoted downwards from an upright or partially reclined position.

20. An article of furniture as claimed in any of claim 16 wherein the back support is pivotally connected to the respective lateral side panels.

21. An article of furniture as claimed in claim 1 wherein the intermediate support comprises an outer support and the base comprises an inner support, or vice versa.

22. An article of furniture as claimed in claim 1 where in the furniture comprises a recliner chair or multiple seat sofa having one or more recliner seats.

23. An article of furniture as claimed in claim 22 wherein the back support comprises the backrest of the recliner chair, the intermediate support comprises the movable frame of the chair including the seat or seat support and/or arm or arms of the chair, and the base support provides at least part of a floor stand.

24. An article of furniture as claimed in claim 22 wherein said first and second guide means are provided at both lateral sides of the chair, or recliner seat of a multiple seat sofa, such that the or each seat is supported and guide by said guide means on both sides thereof.

25. An article of furniture as claimed in claim 22 further comprising a foot rest movable between a stowed and a deployed position, wherein the foot rest is pivotally connected to a linear actuator means for deployment and retraction thereof.

26. An article of furniture as claimed in claim 25 wherein said linear actuator means comprises slide means extendable from a concealed position on the underside of the item of furniture.

27. An article of furniture as claimed in claim 26 wherein the slide means is movable in an inclined direction to raise the position of the pivot between the actuator means and the foot rest when the foot rest is deployed.

28. An article of furniture as claimed in claim 27 wherein said slide means comprises a draw like arrangement with guides on respective sides for sliding the drawer along the guides.

29. An article of furniture as claimed in claim 25 wherein the foot rest further comprises flexible attachment means connected between the foot rest and a fixed anchorage position on the article of furniture such that extension of the actuator causes the footrest to deploy to a position where tensioning of the attachment means occurs which generates a turning moment on the footrest to turn the foot rest about its pivot axis so that it lies in a substantially horizontal plane.

30. An article of furniture as claimed in claim 25 wherein the foot rest is pivotally connected to the linear actuator at or adjacent to a point on said footrest between an upper and lower edge thereof.

31. An article of furniture as claimed in claim 25 wherein the foot rest is biased outwards to its deployed position by biasing means.

32. An article of furniture as claimed in claim 30 wherein said biasing means comprises at least one constant force spring.

33. An article of furniture as claimed in claim 1, further comprising:

a foot rest movable between a stowed position and a deployed position by linear actuator means comprising slide means and at least one constant force spring for biasing the slide means in a direction to deploy the footrest from its stowed to its deployed position.

34. An article of furniture as claimed in claim 1 wherein: the item of furniture comprises an adjustable bed.

35. An article of furniture as claimed in claim 34 wherein: the said back support includes the adjustable backrest of the bed, the intermediate support includes a movable frame or carriage of the bed on which adjustable and non-adjustable body support sections are mounted, and the base support provides at least part of a floor stand or plinth on which the bed is supported.

36. An article of furniture as claimed in claim 34 wherein: said first and second guide means are provided at both lateral sides of the bed such that the adjustable sections is supported and guided by said guide means on both sides of the bed.

37. An adjustable furniture system, comprising:

a base;

an intermediate support;

a back support;

said base being operably linked to said intermediate support;

said back support being operably linked with said intermediate support;

said intermediate support being slidably guided by a first guide means operably for movement relative to said base;

said back support and said intermediate support being simultaneously guided during a use by a second guide means by a movement of said base from a first position to a second position;

said second guide means including at least one guide operably associated with one of said base support and said back support, the at least one guide of the second guide means being shaped as an arcuate curve having no inflection point, and at least one follower operably linked with said other of said base support and said back support; and whereby the back support is pivotably mounted for movement with respect to the intermediate support and the first and said second guide means are operably arranged such that, during said use, a relative movement of said of said base from said first to said second position pivots said back support relative to said intermediate support urging said intermediate support to move operable with respect to said base.

38. An adjustable furniture system, according to claim 37, further comprising:

a sliding fulcrum system comprising said first guide means and said second guide means being operably to transfer a motive force during said use.

39. An adjustable furniture system, according to claim 38, further comprising: a foot rest system operably linked with said base; said foot rest system further comprising a flexible attachment means operably joining a foot rest and a fixed anchorage position on said adjustable furniture system, whereby extension of said intermediate member operably causes said footrest to deploy from a first position to a second position thereby increasing a tension of said flexible attachment means.

40. A method for operating an adjustable furniture system, comprising the steps of: providing a base; providing an intermediate support; providing a back support; operably linking said base to said intermediate support; operably linking said back support with said intermediate support; slidably guiding said intermediate support by a first guide means operably for movement relative to said base; simultaneously guiding said back support and said intermediate support during a use by a second guide means by a movement of said base from a first position to said second position; providing said second guide means with at least one guide operably associated with one of said base support and said back support, the at least one guide of the second guide means being shaped as an arcuate curve having no inflection point, and at least one follower operably linked with said other of said base support and said back support; and pivotably mounting the back support for movement with respect to the intermediate support and the first and said second guide means provided operably arranged such that, during said use, a movement of said of said base from said first to said second position pivoting said back support relative to said intermediate support and urging said intermediate support to move operable with respect to said base.

41. A method for operating an adjustable furniture system, according to claim 40, further comprising the step of: providing a sliding fulcrum system comprising the step of operating said first guide means and said second guide means and transferring a motive force relative to said first guide means and said second guide means during said use.

42. A method for operating an adjustable furniture system, according to claim 40, wherein: said second guide means includes a curvilinear member having at least one extending curved section.

43. A method for operating an adjustable furniture system, according to claim 40, further comprising the steps of: providing a foot rest system operably linked with said base; and wherein said foot rest system further comprising a flexible attachment means operably joining a foot rest and a fixed anchorage position on said adjustable furniture system, whereby extension of said intermediate member operably causes said footrest to deploy from a first position to a second position thereby increasing a tension of said flexible attachment means.

44. An article of adjustable furniture comprising; a base; an intermediate support; and a back support, the intermediate support being guided for movement relative to the base by first guide means, the back support being guided for movement relative to both the base and intermediate support by second guide means, said second guide means including at least one guide associated with one of the base support and the back support and at least one follower associated with the other of the base support and the back support; whereby the back support is mounted for pivotal movement with respect to the intermediate support and the first and second guide means are arranged such that, in use, pivoting of the back support relative to the intermediate support causes the intermediate support to move with respect to the base, wherein the back support is pivotally connected to the intermediate support by at least one connecting lever pivotally connected to the intermediate support, wherein the second guide means provides a fulcrum point for the connecting lever, and wherein the fulcrum is fixed with respect to the base.

45. An article of adjustable furniture comprising; a base; an intermediate support; and a back support, the intermediate support being guided for movement relative to the base by first guide means, the back support being guided for movement relative to both the base and intermediate support by second guide means, said second guide means including at least one guide associated with one of the base support and the back support and at least one follower associated with the other of the base support and the back support; whereby the back support is mounted for pivotal movement with respect to the intermediate support and the first and second guide means are arranged such that, in use, pivoting of the back support relative to the intermediate support causes the intermediate support to move with respect to the base, wherein the intermediate support includes a pair of lateral side panels, and wherein the side panels include the guides of the first guide means which guides accommodate the respective followers, and wherein the guides are provided as respective slots in the side panels.

46. An article of furniture as claimed in claim 45 wherein: each panel includes a pair of said slots which are inclined to guide the intermediate support upwards and forwards with respect to the base when the back support is pivoted downwards from an upright or partially reclined position.

* * * * *